US007789668B1

(12) United States Patent
Hamner et al.

(10) Patent No.: US 7,789,668 B1
(45) Date of Patent: Sep. 7, 2010

(54) CONNECTOR ASSEMBLIES AND SYSTEMS INCLUDING FLEXIBLE CIRCUITS

(75) Inventors: Richard Elof Hamner, Hummelstown, PA (US); Scott Stephen Duesterhoeft, Etters, PA (US); Attalee S. Taylor, Palmyra, PA (US); Jason M'Cheyne Reisinger, Carlisle, PA (US); Brian Patrick Costello, Scotts Valley, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/428,806

(22) Filed: Apr. 23, 2009

(51) Int. Cl.
*H01R 9/09* (2006.01)

(52) U.S. Cl. ..... 439/65; 439/260; 439/67

(58) Field of Classification Search ..... 439/65, 439/260, 67, 62, 77, 493
See application file for complete search history.

(56) References Cited

U.S. PATENT DOCUMENTS

| | | | | |
|---|---|---|---|---|
| 4,085,990 | A | 4/1978 | Jayne | |
| 4,518,210 | A | 5/1985 | Morrison | |
| 4,603,928 | A | 8/1986 | Evans | |
| 4,626,056 | A | 12/1986 | Andrews, Jr. et al. | |
| 4,629,270 | A | 12/1986 | Andrews, Jr. et al. | |
| 4,693,529 | A * | 9/1987 | Stillie | 439/67 |
| 4,731,698 | A | 3/1988 | Millot et al. | |
| 4,840,569 | A | 6/1989 | Cabourne | |
| 4,881,901 | A * | 11/1989 | Mendenhall et al. | 439/65 |
| 5,092,781 | A | 3/1992 | Casciotti et al. | |
| 5,102,342 | A | 4/1992 | Marian | |
| 5,171,154 | A | 12/1992 | Casciotti et al. | |
| 5,228,863 | A | 7/1993 | Campbell et al. | |
| 6,062,872 | A | 5/2000 | Strange et al. | |
| 6,077,090 | A | 6/2000 | Campbell et al. | |
| 6,411,517 | B1 | 6/2002 | Babin | |
| 6,672,878 | B2 | 1/2004 | Dean | |
| 7,297,015 | B1 | 11/2007 | Desrosiers et al. | |
| 7,374,441 | B2 | 5/2008 | Rubenstein | |
| 7,419,400 | B1 | 9/2008 | Taylor et al. | |
| 7,425,134 | B1 | 9/2008 | Taylor | |
| 7,438,582 | B2 | 10/2008 | Taylor | |
| 2007/0097662 | A1 | 5/2007 | Dean | |
| 2008/0227314 | A1 | 9/2008 | Taylor | |

* cited by examiner

*Primary Examiner*—Gary F. Paumen

(57) ABSTRACT

An electrical connector assembly for electrically coupling primary and secondary circuit boards together. The secondary circuit board is held proximate to the primary circuit board and has a first contact array of board contacts thereon. The electrical connector assembly includes a circuit assembly having a second contact array of mating contacts configured to mate with the first contact array and a flexible circuit that electrically couples the second contact array to the primary circuit board. The electrical connector assembly also includes an alignment feature that is configured to engage the secondary circuit board. Also, the electrical connector assembly includes a coupling mechanism that is configured to move the alignment feature and the second contact array between a retracted position, in which the second contact array is located remotely from the first contact array, and an engaged position, in which the first and second contact arrays engage one another.

20 Claims, 18 Drawing Sheets

CONNECTOR ASSEMBLIES AND SYSTEMS INCLUDING FLEXIBLE CIRCUITS

CROSS-REFERENCES TO RELATED APPLICATIONS

Subject matter described herein is similar to subject matter described in patent application Ser. No. 12/428,851 entitled "REMOVABLE CARD CONNECTOR ASSEMBLIES HAVING FLEXIBLE CIRCUITS" and filed contemporaneously herewith, which is incorporated by reference in the entirety.

BACKGROUND OF THE INVENTION

The subject matter herein relates generally to interconnecting circuit boards, and more particularly, to electrical connector assemblies that are configured to electrically couple two circuit boards.

Some electrical systems, such as servers, routers, and data storage systems, utilize connector assemblies for transmitting signals and/or power through the electrical system. Such electrical systems typically include a backplane or a midplane circuit board, a motherboard, and a plurality of daughter cards. The electrical systems also include one or more electrical connectors that are attached to the circuit board(s) for interconnecting the daughter cards to the circuit board(s) when the daughter card is inserted into the electrical system. Each daughter card includes a header or receptacle assembly having a mating face that is configured to connect to a mating face of the electrical connector. The header/receptacle assembly is typically positioned on or near a leading edge of the daughter card. Prior to being mated, the mating faces of the header/receptacle assembly and the electrical connector are aligned with each other and face each other along a mating axis. The daughter card is then moved in an insertion direction along the mating axis until the mating faces engage and mate with each other.

The conventional backplane and midplane connector assemblies provide for interconnecting the daughter cards to the backplane or midplane circuit board by moving the daughter card in an insertion direction which is the same as the mating direction. In some cases it may be desirable to mate the daughter card in a mating direction that is perpendicular to the insertion direction. However, when the header/receptacle assembly is on a surface of the daughter card and faces a direction perpendicular to the insertion direction and the electrical connector is on the backplane circuit board and also faces a direction perpendicular to the insertion direction, the daughter card and the backplane circuit board may be misaligned and unable to connect. In addition, connector assemblies that include a backplane or midplane circuit board may affect the electrical system's cooling capabilities by, for example, limiting airflow through the system.

Accordingly, there is a need for an electrical connector assembly that facilitates interconnection of circuit boards that are oriented in an orthogonal relationship. Furthermore, there is also a need for alternative electrical connector assemblies that are capable of connecting daughter cards to a backplane or midplane circuit boards of the subject systems.

BRIEF DESCRIPTION OF THE INVENTION

In one embodiment, an electrical connector assembly is provided that electrically couples primary and secondary circuit boards together. The secondary circuit board is held proximate to the primary circuit board and has a first contact array of board contacts thereon. The electrical connector assembly includes a circuit assembly having a second contact array of mating contacts configured to mate with the first contact array and a flexible circuit that electrically couples the second contact array to the primary circuit board. The electrical connector assembly also includes an alignment feature that is configured to engage the secondary circuit board. Also, the electrical connector assembly includes a coupling mechanism that supports the alignment feature and the second contact array. The alignment feature and the second contact array have fixed positions relative to each other. The coupling mechanism is configured to move the alignment feature and the second contact array between a retracted position, in which the second contact array is located remotely from the first contact array, and an engaged position, in which the first and second contact arrays engage one another. The alignment feature cooperates with the secondary circuit board to align the first and second contact arrays when the second contact array is moved to the engaged position.

In another embodiment, an electrical system is provided that includes a primary circuit board and a secondary circuit board that has a first contact array of board contacts thereon. The system also includes a board holder that is configured to hold the secondary circuit board proximate to the primary circuit board. Also, the system includes a circuit assembly that has a second contact array of mating contacts configured to mate with the first contact array and a flexible circuit that electrically couples the second contact array to the primary circuit board. The system further includes an alignment feature that is configured to engage the secondary circuit board. Also, the system has a coupling mechanism that supports the alignment feature and the second contact array. The alignment feature and the second contact array have fixed positions relative to each other. The coupling mechanism is configured to move the alignment feature and the second contact array between a retracted position, in which the second contact array is located remotely from the first contact array, and an engaged position, in which the first and second contact arrays engage one another. The alignment feature cooperates with the secondary circuit board to align the first and second contact arrays when the second contact array is moved to the engaged position.

DETAILED DESCRIPTION OF THE INVENTION

Figure 1:
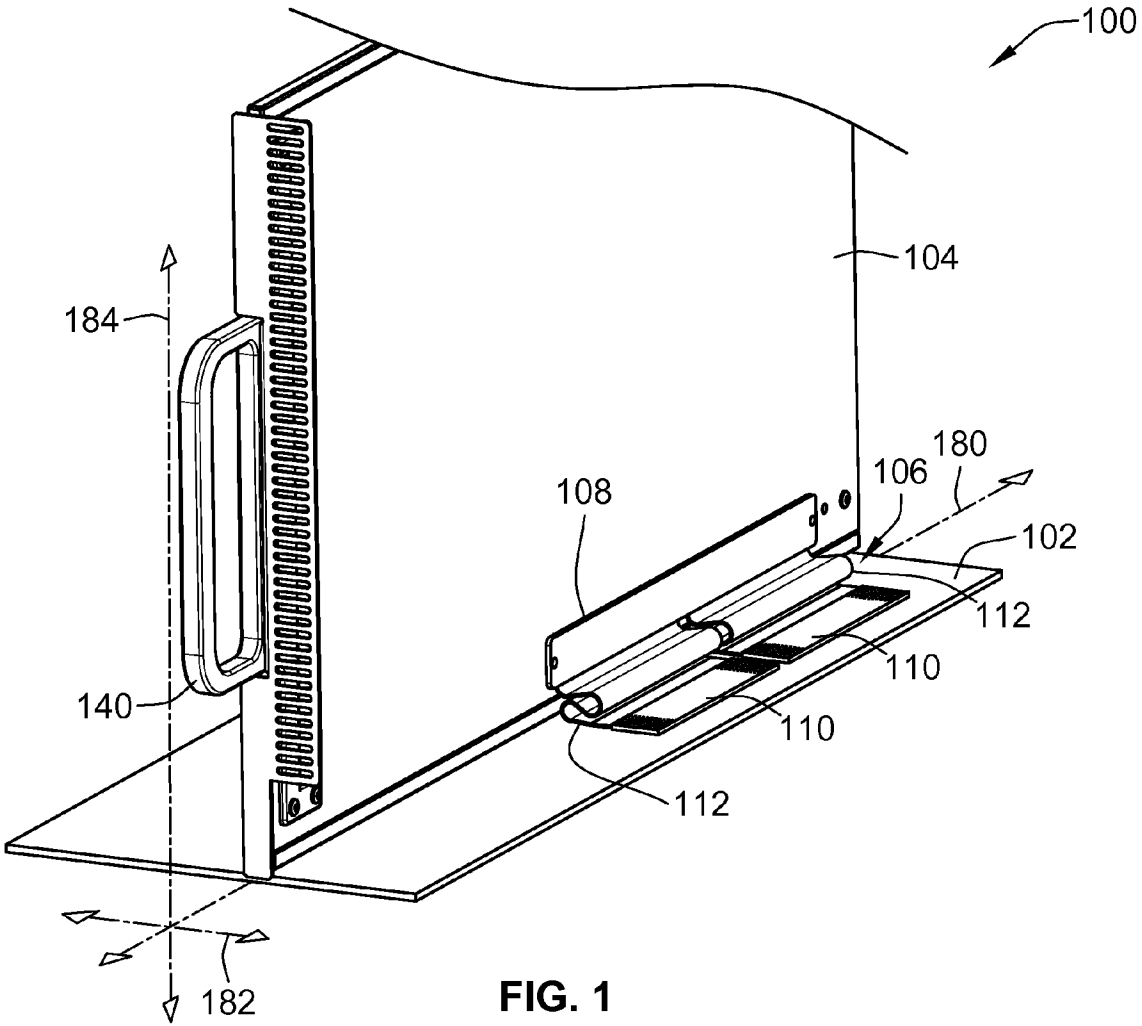
FIG. 1 is a front perspective view of an electrical system formed in accordance with one embodiment.

FIG. 1 is a front perspective view of an electrical system 100 formed in accordance with one embodiment that includes a primary circuit board 102 and a secondary circuit board 104 that are electrically coupled to one another through a circuit assembly 106. The circuit assembly 106 includes one or more contact arrays 108 that are configured to engage the secondary circuit board 104, one or more contact arrays 110 that are configured to engage the primary circuit board 102, and one or more flexible circuits 112 that connect the contact arrays 108 and 110. As used herein, the term "contact array" includes a plurality of mating contacts arranged in a predetermined configuration and held together by a common base material or structure. For example, a contact array may include or be part of a printed circuit or an interposer. A variety of mating contacts may be used in the contact arrays, including contacts that are stamped and formed, etched and formed, solder balls, pads, press-fit contacts, and the like.

As used herein, the term "printed circuit" includes any electric circuit in which the conducting connections have been printed or otherwise deposited in predetermined patterns on an insulating base. For example, printed circuits may be circuit boards, interposers made with printed circuit board material, flexible circuits, substrates having one or more layers of flexible circuit therealong, and the like. In the illustrated embodiment, the contact arrays 108 and 110 are part of a corresponding printed circuit and are configured to engage board contacts along one of the primary and secondary circuit boards 102 and 104. Both the contact arrays 108 and 110 may be moved to and from the secondary and primary circuit boards 104 and 102, respectively.

An "interposer," as used herein, includes a planar body having opposing sides with corresponding contact arrays and a plurality of conductive pathways extending therebetween to connect the contact arrays. An interposer may be a printed circuit where mating contacts are etched and formed along two opposing sides of a circuit board. The circuit board may have conductive pathways coupling each mating contact to a corresponding mating contact on the other side. However, in other embodiments, the interposer might not be printed circuit. For example, an interposer may include a carrier having a planar body with a plurality of holes extending therethrough. Stamped and formed mating contacts may be arranged by the carrier such that each mating contact is positioned within a corresponding hole. The mating contacts may interface with one circuit board on one side of the carrier and have ball contacts that are soldered to another circuit board on the other side of the carrier. Furthermore, an interposer may take other forms.

Returning to FIG. 1, in some embodiments, the primary circuit board 102 may be a motherboard and the secondary circuit board 104 may be a removable daughter card, e.g., a line or switch card, that may be removably coupled to or engaged with the circuit assembly 106. As will be discussed below, the circuit assembly 106 is configured to allow the contact array 108 to be moved from a retracted position to an engaged position where the primary and secondary circuit boards 102 and 104 are electrically coupled through the circuit assembly 106. The contact array 108 may be held and moved by, for example, coupling mechanisms 204 (shown in FIG. 3), 504 (FIG. 7), 304 (FIG. 10), and 404 (FIG. 12), which will be described in further detail below. When the contact array 108 is in the retracted position, the secondary circuit board 104 may be inserted into or removed from the system 100.

The circuit assembly 106 may be mounted to the primary circuit board 102 by, for example, using press-fit contacts. Alternatively, the contact arrays 110 may be soldered or attached to the primary circuit board 102 using a fastener and a compressible interface. Also, in alternative embodiments, the contact array 110 may be moved from a retracted position to an engaged position along the primary circuit board 102. Such embodiments are described in greater detail in the patent application Ser. No. 12/428,851, which is incorporated by reference in the entirety.

As used herein, the term "removably coupled" means that the two coupled components, such as the secondary circuit board 104 and the contact array 108, may be readily separated from and coupled to each other without destroying or damaging either of the components or corresponding mating or board contacts. When the secondary circuit board 104 and the contact array 108 are coupled, corresponding contacts are electrically engaged with each other. Also, in some embodiments, the contacts may be co-planar, but are not required to be co-planar in other embodiments. A "flexible circuit" (also called flex circuit), as used herein, is a printed circuit that includes an arrangement of conductors embedded within or between flexible insulating material(s). The flexible circuit 112 is configured to convey an electrical current between the components that the flexible circuit 112 interconnects. By way of an example, the flexible insulating materials of the flexible circuit 112 may form a flat, rectangular ribbon capable of folding over itself without damaging the conductors or substantially affecting the current flow.

In some embodiments, the flexible circuit 112 may be attached to a rigid substrate or may form a rigid substrate. The contact arrays 108 and 110 may be located along the rigid, substrate. The rigid substrate may facilitate holding and moving arrays of contacts. For example, the rigid substrate may be a circuit board or an interposer. As another example, the flexible circuit 112 may include or form the contact arrays 108 and/or 110. More specifically, the flexible circuit 112 may extend along or be attached to one side of a rigid panel using an adhesive. The conductors within the flexible circuit 112 may form an array of pads (i.e., a contact array) that are exposed to the outer environment. The pads may then be engaged by mating contacts in order to establish the electrical connection.

Furthermore, the embodiments described herein may utilize one or more alignment mechanisms to facilitate aligning the mating and board contacts. As used herein, an "alignment feature" includes alignment projections, apertures, edges or frames that may cooperate with each other in aligning the contacts. In some embodiments, the alignment feature(s) has a fixed position with respect to a contact array(s).

The system 100 shown in FIG. 1 may be a variety of host electrical systems, such as a server system, router system, or data storage system. However, although the illustrated embodiment is described with reference to interconnecting the primary and secondary circuit boards 102 and 104, the description herein is not intended to be limiting. Embodiments described herein may be used to interconnect any type of circuit boards or other electrical components where one component has an array of mating contacts and the other component has a complementary array of mating contacts.

The primary and secondary circuit boards 102 and 104 may be in fixed or locked positions and substantially orthogonal to one another before the contact array 108 is moved toward and engages the secondary circuit board 104. More specifically, the primary circuit board 102 extends along a horizontal plane defined by a longitudinal axis 180 and a horizontal axis 182, and the secondary circuit board 104 extends along a vertical or longitudinal plane defined by the longitudinal axis 180 and a vertical axis 184. However, in other embodiments, the primary and secondary circuit boards 102 and 104 may be substantially orthogonal (or perpendicular) to one another (e.g., 90°/−20°), parallel to one another, or may form some other angle or some other positional relationship with respect to each other. For example, the primary and secondary circuit boards 102 and 104 may be oblique to one another.

Also, the secondary circuit board 104 may include a handle 140 affixed to an edge of the secondary circuit board 104. The handle 140 may facilitate an operator or machine in removing the secondary circuit board 104 from the system 100.

Figure 2A:
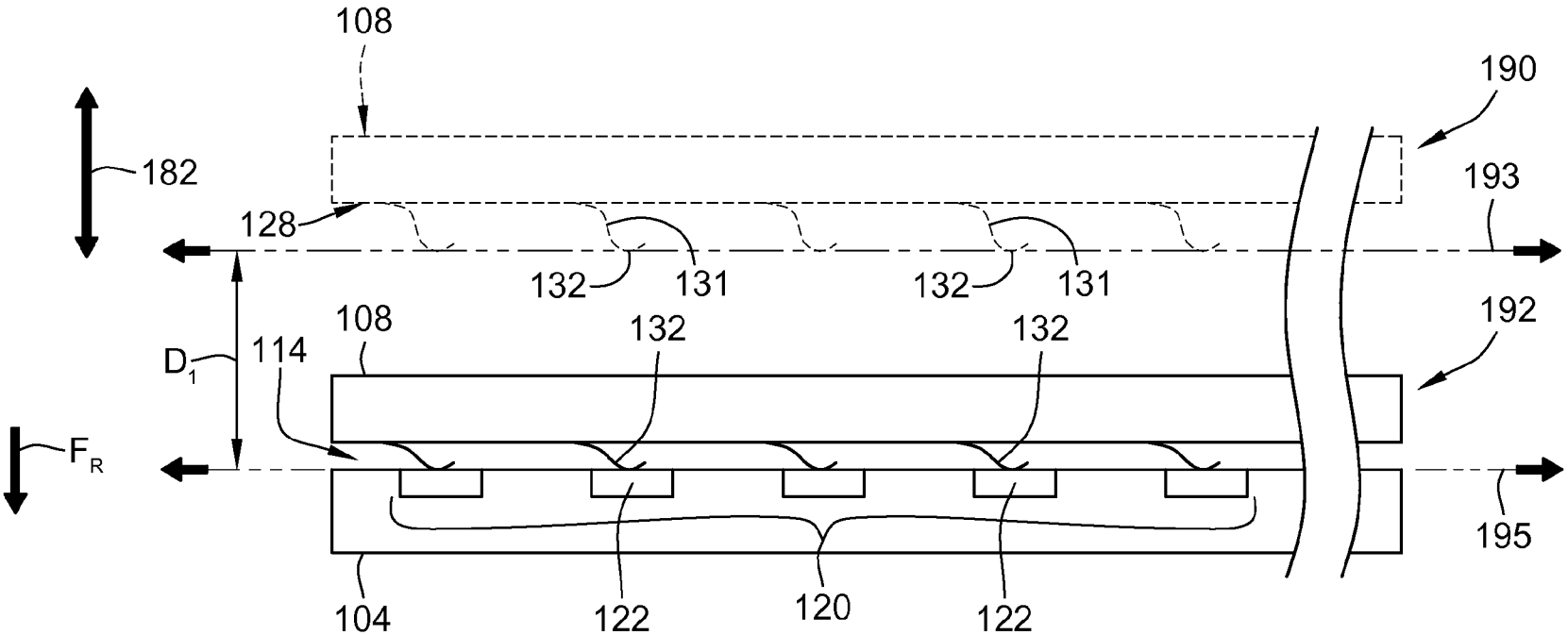
FIG. 2A is a top cross-sectional view of a secondary circuit board and a printed circuit that may be used with the system shown in FIG. 1.

FIG. 2A is a top cross-sectional view illustrating the contact array 108 in a retracted position 190 (shown in dashed lines) and in an engaged position 192 (solid lines) with respect to the secondary circuit board 104. The circuit assembly 106 (FIG. 1) is configured to allow the contact array 108 to be moved bidirectionally along the horizontal axis 182 in a linear manner between the retracted position 190 and the engaged position 192. As shown, the secondary circuit board 104 has board contacts 122 and the contact array 108 has mating contacts 132. In the retracted position 190, the mating contacts 132 of the contact array 108 are spaced (i.e., a distance $D_1$ away) from corresponding board contacts 122 of the secondary circuit board 104. In the engaged position 192, each mating contact 132 is electrically coupled to or engaged to one of the board contacts 122.

More specifically, the secondary circuit board 104 has a board surface 114 that includes a contact array 120 of board contacts 122. The contact array 108 has a mating surface 128 that may extend adjacent to and substantially parallel to the board surface 114. The mating surface 128 faces the board surface 114. As will be discussed further below, the contact array 108 may be held and moved by a coupling mechanism (e.g., by coupling mechanisms 204, 304, 404, and 504 shown in FIGS. 3, 10, 12, and 7 respectively) toward the secondary circuit board 104 until the corresponding board and mating contacts 122 and 132 are engaged. As such, the contact array 108 may be removably coupled to or engaged with the contact array 120 of the secondary circuit board 104.

In the illustrated embodiment, the mating surface 128 and the board surface 114 extend substantially parallel to one other while in the engaged and retracted positions 192 and 190, respectively, and in any position therebetween. The mating contacts 132 of the contact array 108 may form a contact plane 193 that is substantially parallel to a board plane 195 formed by the board surface 114 and/or the board contacts 122. As such, each mating contact 132 may be aligned with the corresponding board contact 122, but spaced apart from the corresponding board contact 122 by substantially the same distance $D_1$. When the contact array 108 is moved toward the secondary circuit board 104 in a linear manner along the horizontal axis 182, the distance $D_1$ that separates the mating contacts decreases until the mating contacts 132 and board contacts 122 are engaged.

Although the contact array 108 and the secondary circuit board 104 may be parallel and equally spaced apart when in the engaged and retracted positions 192 and 190, respectively, in alternative embodiments, the contact array 108 may be moved toward and engage the secondary circuit board 104 in other manners. For example, the board surface 114 and the mating surface 128 may be parallel, but the contact array 108 may approach the secondary circuit hoard 104 at an angle such that the board contacts 122 and mating contacts 132 become aligned when the contact array 108 reaches the engaged position. In another alternative embodiment, the board surface 114 and the mating surface 128 may not be parallel when in the retracted position, but may become aligned and parallel with each other when the contact array 108 is in the engaged position.

In FIG. 2A, the board contacts 122 of the secondary circuit board 104 are pads that are flush with the board surface 114 and the mating contacts 132 of the contact array 108 include resilient beams 131 that project from the mating surface 128. However, in alternative embodiments, the board contacts 122 may include resilient beams that project from the board surface 114 and the mating contacts 132 may be flush with the mating surface 128 of the contact array 108. Furthermore, the board and mating contacts 122 and mating contacts 132 may both be pads configured to engage each other. The board and mating contacts 122 and 132 may have other forms as well.

In the illustrated embodiment, the mating contacts 132 include resilient beams 131 that flex to and from the mating surface 128. The resilient beams 131 resist deflection and exert a resistance force $F_R$ in a direction away from the mating surface 128. As such, the resilient beams 131 may compensate for slight misalignment between the mating contacts 132 of the contact array 108 and the board contacts 122 of the contact array 120 when the contact array 108 is moved into the engaged position 192.

In alternative embodiments, the resilient beams 131 of the mating contacts 132 may be bifurcated or the mating contacts 132 may include two separate beams that project toward each other or in opposite directions. The dual-beam mating contacts 132 may be configured to engage one corresponding board contact 122. As such, the bifurcated beam or the dual-beam mating contacts 132 may have two separate contact points with the corresponding board contact 122. Also, in other alternative embodiments, the mating contacts 132 may be rounded protrusions or pads that project away from the mating surface 128.

Figure 2B:
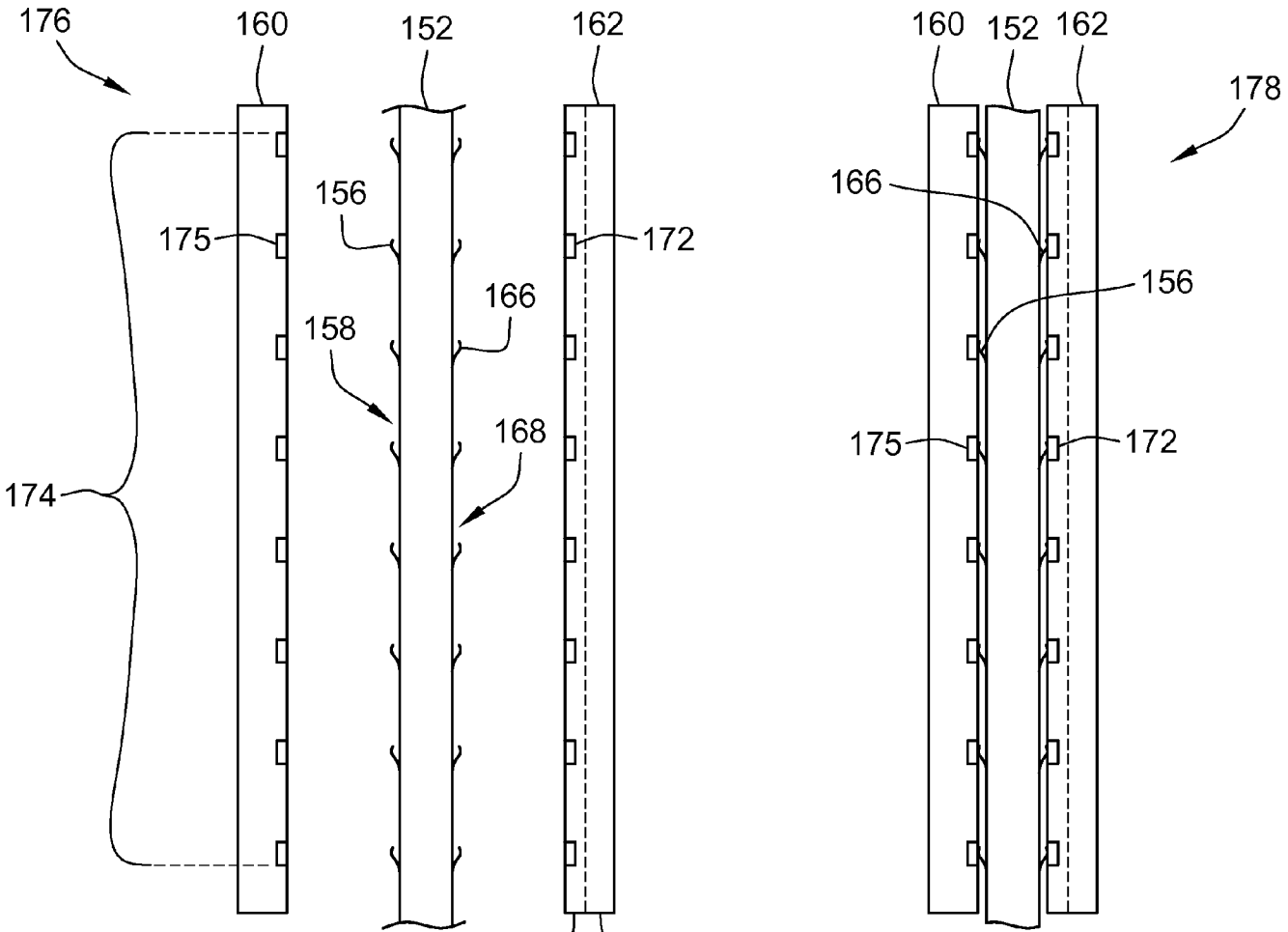
FIG. 2B is a top cross-sectional view of a printed circuit that may be used in an alternative embodiment.

FIG. 2B illustrates a contact array 152 that may be used in an alternative embodiment and shows the contact array 152 in a retracted position 176 and in an engaged position 178 with respect to a secondary circuit board 160 and another contact array 162. As shown, the contact array 152 may be an interposer that includes a plurality of mating contacts 156 on a mating surface 158 that faces the secondary circuit board 160. The contact array 152 may also have another plurality of mating contacts 166 on a mating surface 168 that faces the contact array 162.

The contact array 162 may include, for example, a flex circuit 163 that is coupled to a substrate or stiffener 165. The contact array 162 has a plurality of mating contacts 172 that are configured to engage the mating contacts 166 on the mating surface 168. The secondary circuit board 160 may have a contact array 174 of board contacts 175 configured to engage the mating contacts 156 on the mating surface 158. As shown, when the contact arrays 152 and 162 and the secondary circuit board 160 are moved to the engaged position 178, the mating contacts 156 engage the board contacts 175 and the mating contacts 166 engage the mating contacts 172. As such, the contact array 152 may be an intervening electrical component that is sandwiched between the secondary circuit board 160 and the contact array 162 to establish an electrical connection therebetween.

In other embodiments, the contact array 152 may be fastened against the contact array 162 so that the mating contacts 166 engage the mating contacts 172. The coupled contact arrays 152 and 162 may then be moved as a unit toward and away from the secondary circuit board 160.

Figure 3:
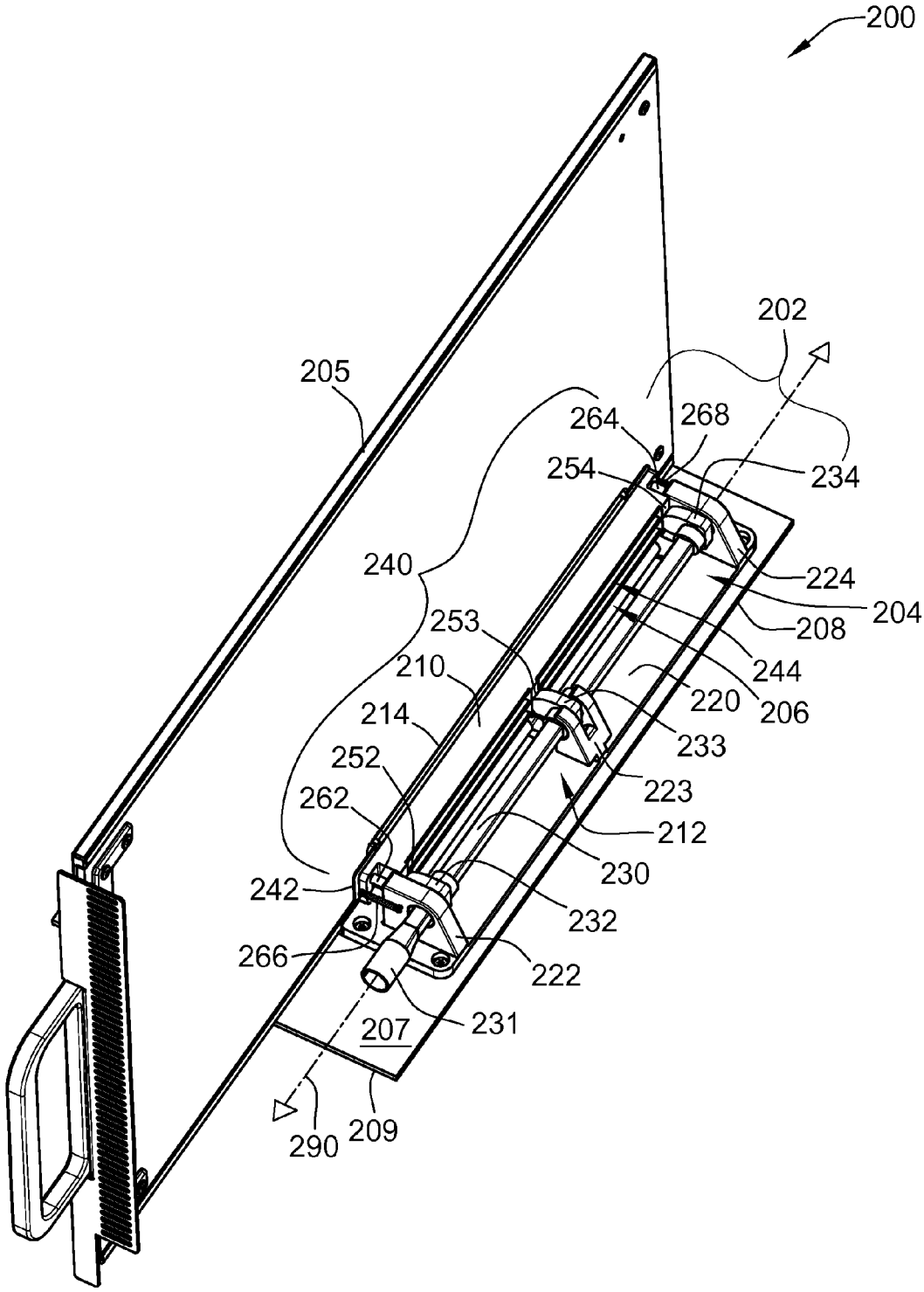
FIG. 3 is a rear perspective view of an electrical connector assembly formed in accordance with one embodiment.
Figure 6:
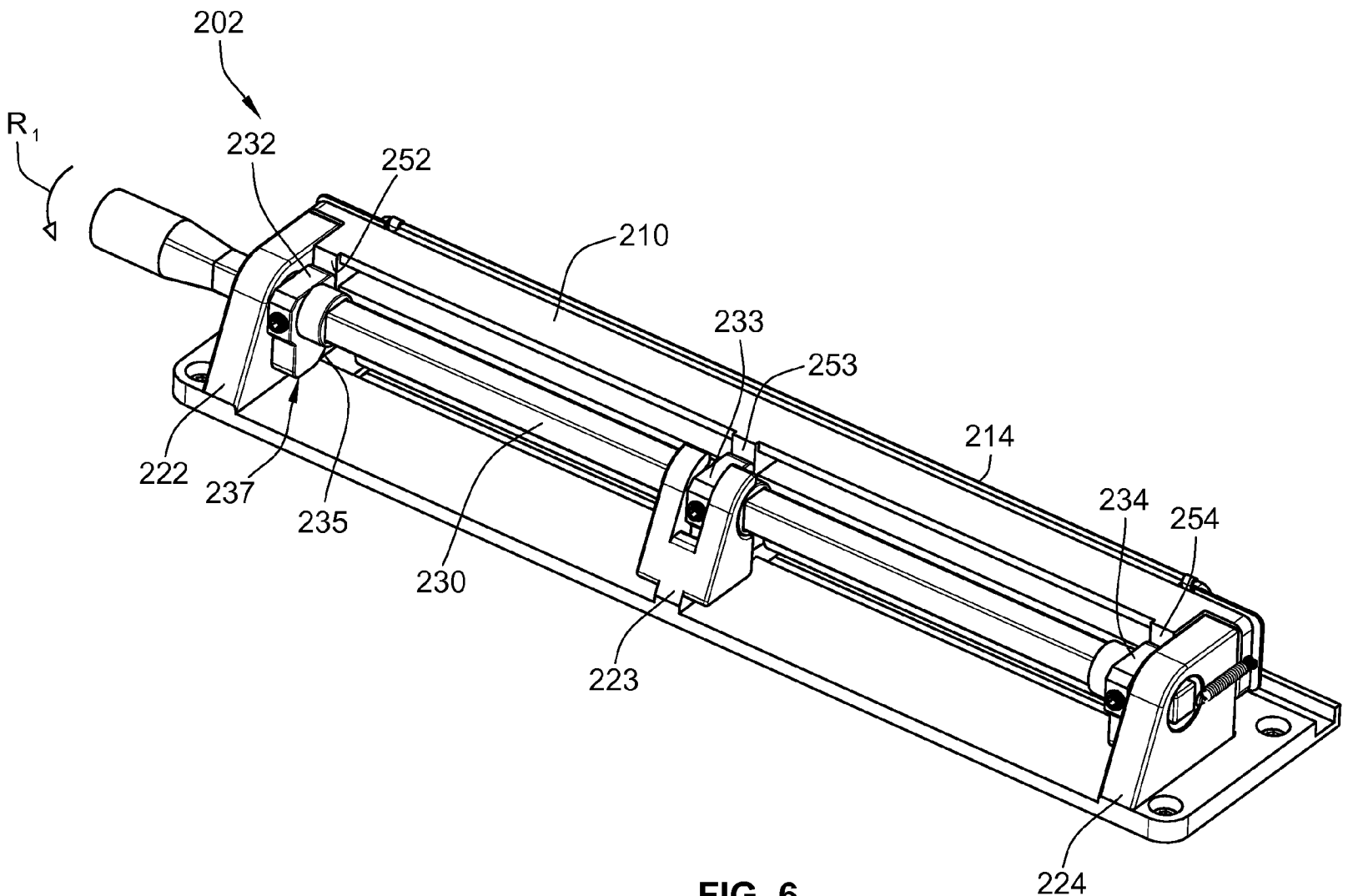
FIG. 6 is a rear perspective view of the electrical connector assembly shown in FIG. 3 when in a retracted position.

FIG. 3 is a rear perspective view of an electrical system 200 that includes an electrical connector assembly 202 that is formed in accordance with one embodiment. The electrical connector assembly 202 includes the coupling mechanism 204 and a circuit assembly 206. The coupling mechanism 204 is configured to move a contact array 214 of the circuit assembly 206 toward and away from a secondary circuit board 205 between the engaged and retracted positions. (The engaged position is shown in FIG. 3 and the retracted position is shown in FIG. 6). The secondary circuit board 205 may have an array of board contacts (not shown) configured to engage the contact array 214.

The coupling mechanism 204 includes a base frame 208, a header 210 configured to hold the contact array 214, and an actuator assembly 212 configured to move the header 210 in a substantially linear direction along the base frame 208. As shown, the base frame 208 may be affixed to a board surface 207 of a primary circuit board 209. The base frame 208 may include a planar support body 220 that extends along the board surface 207 and a plurality of axle supports 222-224 that project from the support body 220 and away from the primary circuit board 209. The actuator assembly 212 includes an axle 230 and a plurality of cam fingers 232-234 distributed thereon. The axle 230 is rotatably coupled to the axle supports 222-224 such that the axle 230 may be rotated about an axis 290 that is substantially parallel to the longitudinal axis 180 (FIG. 1) and to the secondary circuit board 205. In one embodiment, the axle 230 has an end 231 that is configured to engage a tool (not shown) that may manipulate the orientation and/or rotation of the axle 230. The cam fingers 232-234 are attached to the axle 230 and project in a common direction. As will be discussed in greater detail below, the cam fingers 232-234 are configured to move the header 210 away from the axle supports 222-224 when the axle 230 is rotated. As shown in FIG. 3, the cam fingers 232-234 have been rotated such that the contact array 214 is in the engaged position with respect to the secondary circuit board 205.

Also shown in FIG. 3, the header 210 may have an elongated support beam 240 that is coupled to and supports a mating side 242 that faces the secondary circuit board 205. The mating side 242 includes the contact array 214. The support beam 240 includes a rear side 244 having backstops 252-254 distributed thereon that are in slidable contact with corresponding cam fingers 232-234. Furthermore, the support beam 240 includes pistons 262 and 264 that project outwardly from the rear side 244 and are configured to slide into and out of the axle supports 222 and 224, respectively, in a direction along the horizontal axis 182 (FIG. 1).

Also shown, springs 266 and 268 are each coupled to one end of the support beam 240 and an adjacent axle support 222 and 224, respectively. The springs 266 and 268 provide a biasing force that pulls the support beam 240 toward the axle supports 222 and 224.

Figure 4:
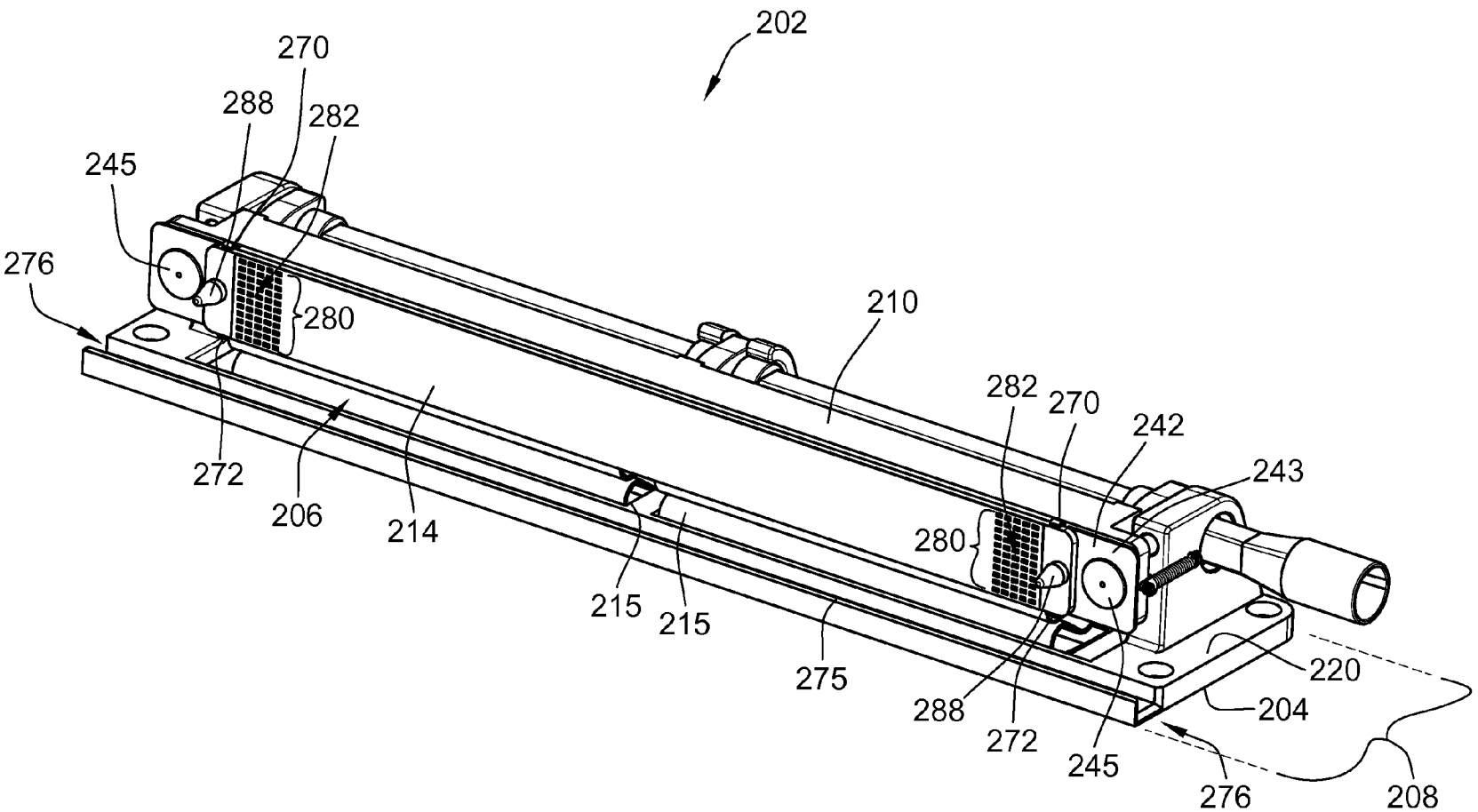
FIG. 4 is a front perspective view of the electrical connector assembly shown in FIG. 3.

FIG. 4 is a front perspective view of the electrical connector assembly 202 and illustrates the circuit assembly 206 in conjunction with the coupling mechanism 204. As shown, the mating side 242 may include a panel 243 that is coupled to the header 210 through a pair of collets 245. The mating side 242 may include pairs of opposing latches 270 and 272 that are configured to hold the contact array 214 alongside the panel 243. The latches 270 and 272 may allow some movement of the contact array 214. Furthermore, the contact array 214 may be attached to flexible circuits 215 of the circuit assembly 206, which may bend or fold over itself within the support body 220. Although not shown, the flexible circuits 215 may couple to the primary circuit board 209 (FIG. 3) under the support body 220 of the base frame 208.

Also shown, the base frame 208 may include a board holder 275 that is configured to hold the secondary circuit board 205 (FIG. 3) proximate and orthogonal to the primary circuit board 209. For example, the board holder 275 may include a guide channel or groove 276 that is configured to receive the secondary circuit board 205 and allow the secondary circuit board 205 to be moved in a longitudinal direction (i.e., parallel to the longitudinal axis 180 (FIG. 1)). In one embodiment, the guide channel 276 is configured to direct the secondary circuit board 205 into a locked position before the coupling mechanism 204 is activated or the header 210 is moved. In the locked position, the array (not shown) of board contacts (not shown) on the secondary circuit board 205 are substantially aligned with sub-arrays 280 of mating contacts 282 on the contact array 214.

Although the board holder 275 is shown as being integrally formed with the base frame 208 in FIG. 4, the board holder 275 (and, more specifically', the guide channel 276) may be separate from the base frame 208 in alternative embodiments. Furthermore, the board holder 275 is not limited to being a channel or groove, but may be other parts or components configured to hold the secondary circuit board 205. For example, the board holder 275 may include separate grips that hold the secondary circuit board 205 proximate to (e.g., on or within a few centimeters) the primary circuit board 209. In addition, the board holder 275 may be configured to move the secondary circuit board 205 while the contact array 214 is being moved. As such, the board holder 275 may hold the secondary circuit board 205 in a fixed or locked position, or the board holder 275 may hold the secondary circuit board 205 and allow limited motion of the secondary circuit board 205 within a predetermined range from the contact array 214.

Figure 5A:
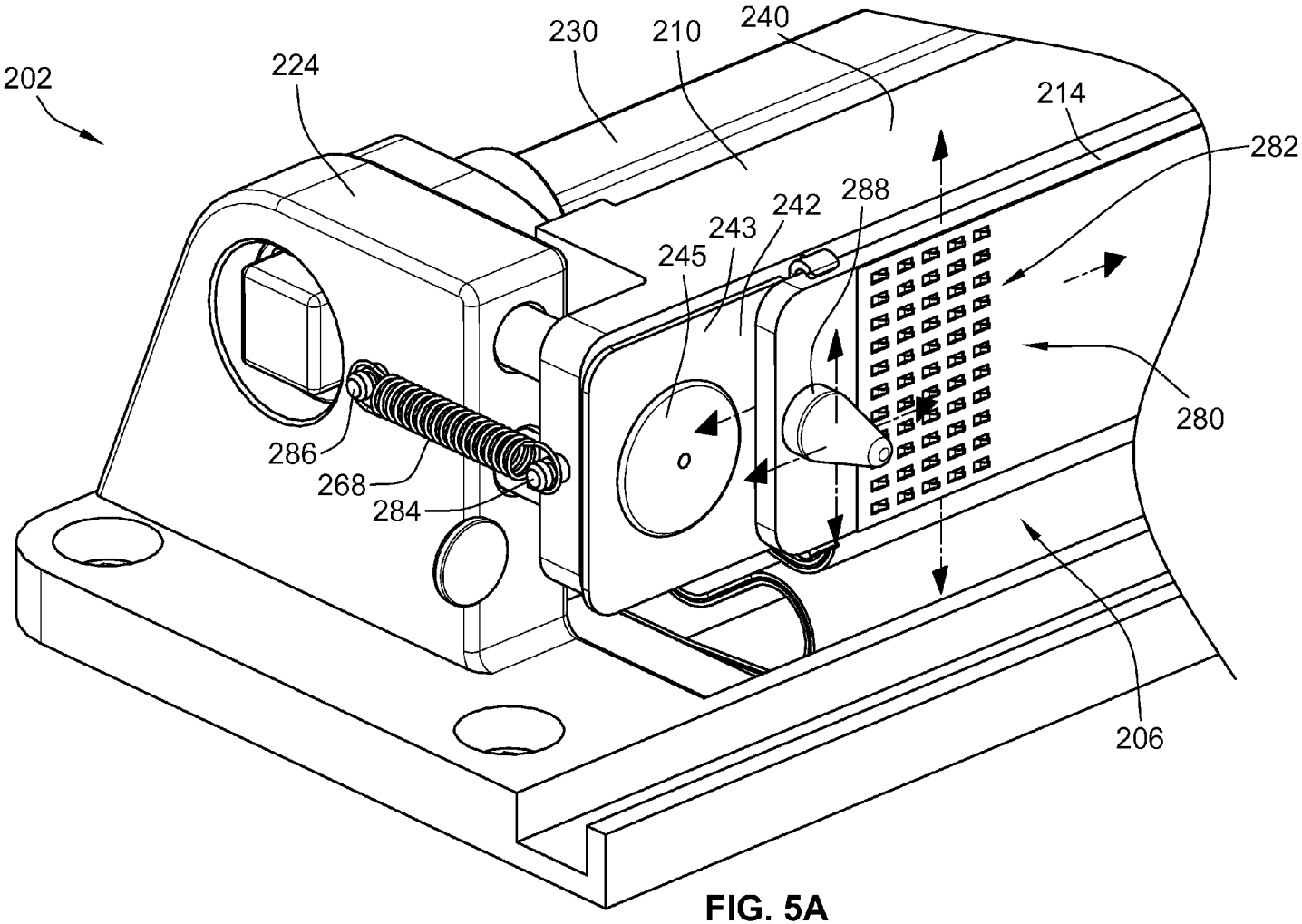
FIG. 5A is an enlarged perspective view of one end of the electrical connector assembly shown in FIG. 4.

FIG. 5A is an enlarged perspective view of one end of the electrical connector assembly 202. Although not shown, the other end of the electrical connector assembly 202 may have similar features as described herein. The spring 268 is coupled at one end to a pin projection 284 on the support beam 240 and another end to a pin projection 286 of the axle support 224. As such, the spring 268 may provide a biasing force that biases the header 210 toward the axle 230. The contact array 214 may include an alignment projection 288 that projects outwardly from the corresponding surface. The alignment projection 288 has a fixed relationship with respect to the mating contacts 282. Alternatively, the alignment projection 288 may have other positions on the mating side 242 (e.g., on the panel 243) provided that the positions are fixed with respect to the sub-array 280 of the mating contacts 282.

Also shown, the collet 245 grips the panel 243 such that the panel 243 and contact array 214 are floatably coupled to the header 210.

Figure 5B:
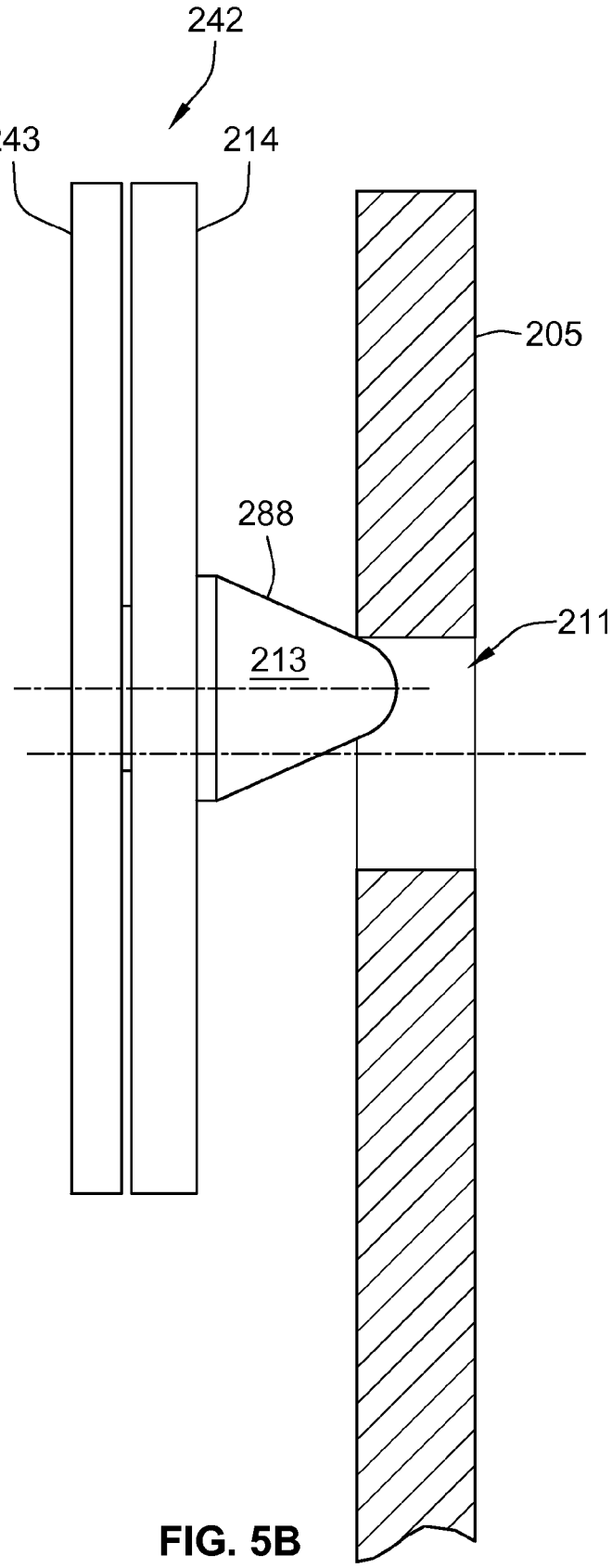
FIG. 5B is a cross-sectional side view of a portion of the electrical connector assembly shown in FIG. 5A illustrating an alignment mechanism.

FIG. 5B illustrates the interaction between the alignment projection 288 and the secondary circuit board 205. As discussed above, embodiments described herein may include an alignment mechanism to facilitate aligning the mating contacts and board contacts before or when the corresponding contacts are mated. In the illustrated embodiment, the alignment projection 288 is a conical projection coupled to and extending from the contact array 214. The secondary circuit board 205 may have a corresponding hole or aperture 211 that has a fixed position relative to the board contacts of the secondary circuit board 205. The aperture 211 is configured to receive the alignment projection 288 when the contact array 214 is moved from the retracted position to the engaged position.

By way of example, in some embodiments, the mating side 242 may float with respect to the header 210 (FIG. 3). The collets 245 (FIG. 4) are moveable within the header 210 and grip the panel 243 so that the panel 243 and, consequently, the contact array 214 are floatable with respect to the header 210. When the contact array 214 is moved toward the secondary circuit board 205, a surface 213 of the alignment projection 288 may engage the corresponding aperture 211. Due to the conical shape of the surface 213 of the alignment projection 288, the alignment projection 288 and corresponding aperture 211 in the secondary circuit board 205 cooperate in aligning the contact array 214 and the secondary circuit board 205 so that the contacts are properly aligned. Because the secondary circuit board 205 is in a fixed position and the contact array 214 is floatable, the contact array 214 may be moved in any of the directions shown by arrows in FIG. 5A (i.e. along the vertical plane formed by the axes 180 and 184 in FIG. 1) in order to align the contacts.

Alternative alignment mechanisms may be used. For example, the alignment projection 288 may be a cylindrical pin that projects from the mating side 242 (e.g., the contact array 214 or the panel 243). The secondary circuit board 205 may have a conical or funnel-like aperture with a hole at the bottom configured to receive the pin. When the contact array 214 is moved toward the secondary circuit board 205, the pin may engage the surface of the conical aperture and be directed toward the hole where the pin is eventually received. As such, this alternative alignment mechanism may operate similarly to the illustrated mechanism described above. In addition, the alignment projection 288 may have other shapes (e.g., pyramid, semi-spherical).

In other alternative embodiments, the secondary circuit board 205 may have the alignment projection 288 and the mating side 242 may have the corresponding aperture 211. Furthermore, alternative embodiments may use multiple alignment features on each end or both ends of the secondary circuit board 205 and the mating side 242. For example, the mating side 242 may have an alignment projection 288 configured to engage an aperture 211 in the secondary circuit board 205 and also an aperture 211 configured to receive an alignment projection 288 from the secondary circuit board 205.

Also, although not shown, the alignment features may be a frame or other guiding structure that engages an edge when the contact array 214 approaches the secondary circuit board 205. The frame and the edge have fixed positions with respect to their corresponding contacts. More specifically, a frame may surround the board contacts and project from the secondary circuit board 205. When the contact array 214 approaches the secondary circuit board 205, an edge of the contact array 214 or the panel 243 may engage the frame. The frame may be shaped to redirect the contact array 214 if the contact array 214 approaches the secondary circuit board 205 along a misaligned path so that the corresponding mating and board contacts engage. Alternatively, the contact array 214 or the connector assembly 202 may have a frame or other guiding structure and the secondary circuit board 205 may have an edge. Similar to above, when the contact array 214 approaches the secondary circuit board 205, the frame may engage the edge and redirect the contact array 214 so that the corresponding contacts engage.

Accordingly, embodiments described herein may provide a moveable contact array that is floatable, i.e., capable of moving in various directions to properly align the contact array of mating contacts with the corresponding array of board contacts. As described above with respect to the mating contacts 132, the mating contacts 282 (FIG. 5A) may have resilient beams that flex to and from the mating surface (not shown). When engaged to the corresponding board contact, the mating contact 282 provides a force against the board surface. The combined forces of the mating contacts 282 and the floatable capability of the contact array 214 may cooperate together in properly aligning the mating contacts 282 with the board contacts.

FIG. 6 is a rear perspective view of the electrical connector assembly 202 when the header 210 and the contact array 214 are in the retracted position. As shown with respect to the cam finger 232, the cam fingers 232-234 may include curved edges 235 that engage the corresponding backstop 252-254 when the axle 230 is rotated. More specifically, as shown with respect to the backstop 252, the curved edge 235 is in slidable contact with the backstop 252. When the contact array 214 and the header 210 are in the retracted position, an elongated body of the cam finger 232 is projecting in a direction that is not toward the secondary circuit board 205 (FIG. 3) (e.g., projecting downward toward the primary circuit board 209 (FIG. 3)). When the axle 230 is rotated (indicated by the arrow $R_1$), the cam finger 232 pushes against the backstop 252 causing the header 210 to move away from the axle supports 222-224.

Also shown, each cam finger 232-234 may include a flat portion 237 of the curved edge 235. When the cam finger 232 is pointing toward the header 210 such that the contact array 214 is in the engaged position, the flat portion 237 provides a locking feature or mechanism to prevent the contact array 214 from being inadvertently disengaged with the secondary circuit board 205.

Figure 7:
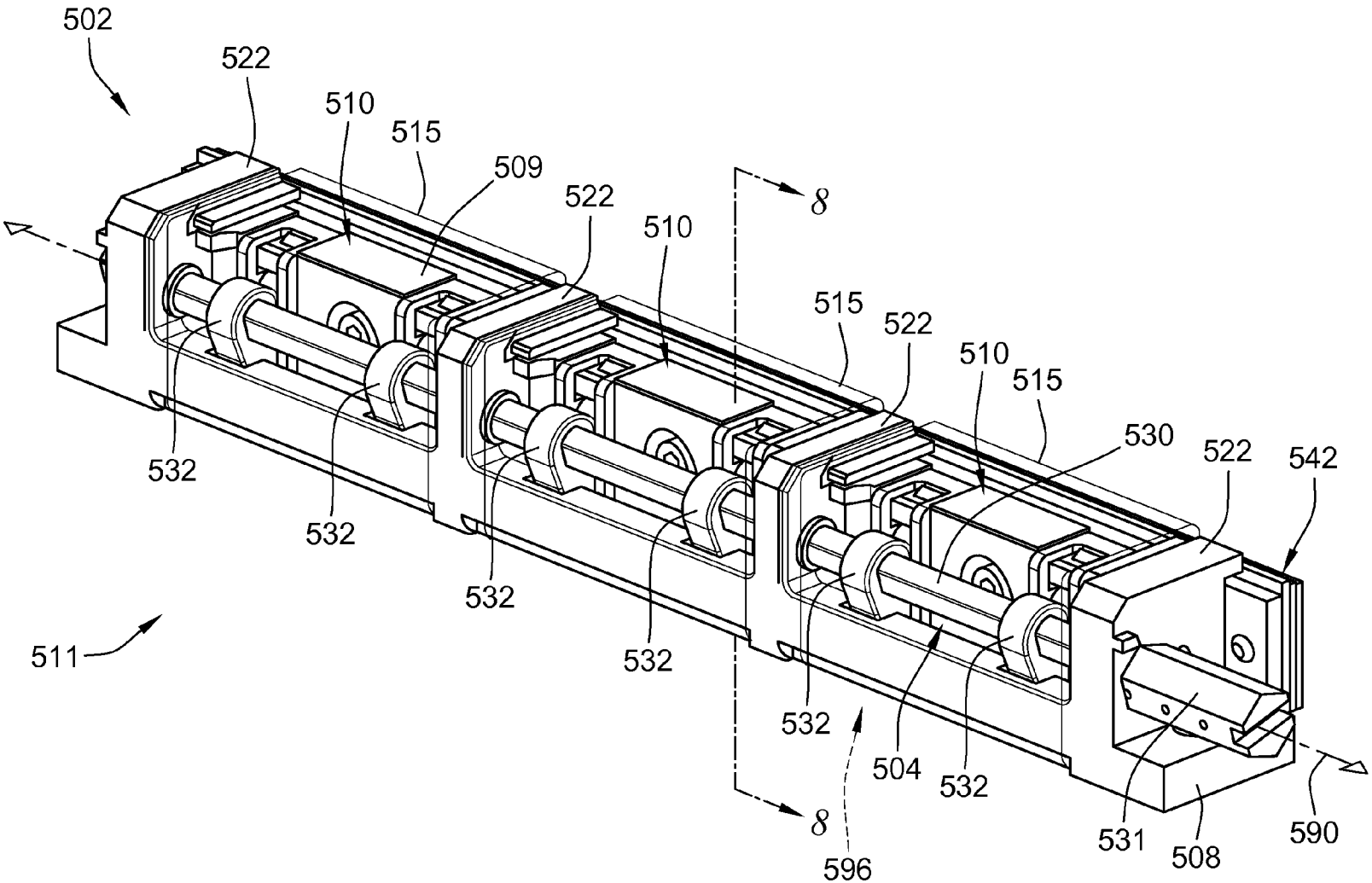
FIG. 7 is a rear perspective view of an electrical connector assembly formed in accordance with an alternative embodiment.
Figure 8:
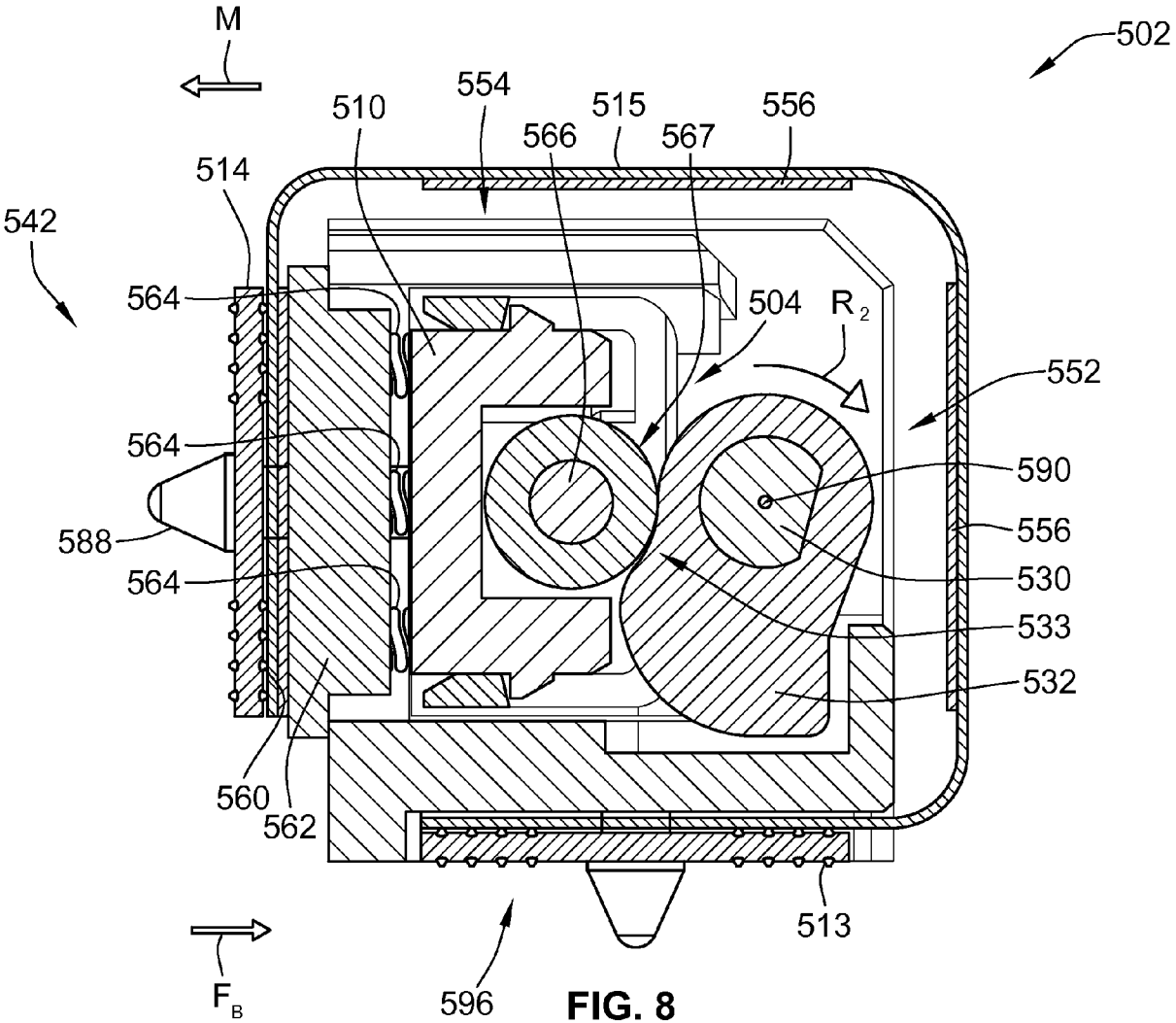
FIG. 8 is a cross-sectional view of the electrical connector assembly taken along the line 8-8 shown in FIG. 7.
Figure 9:
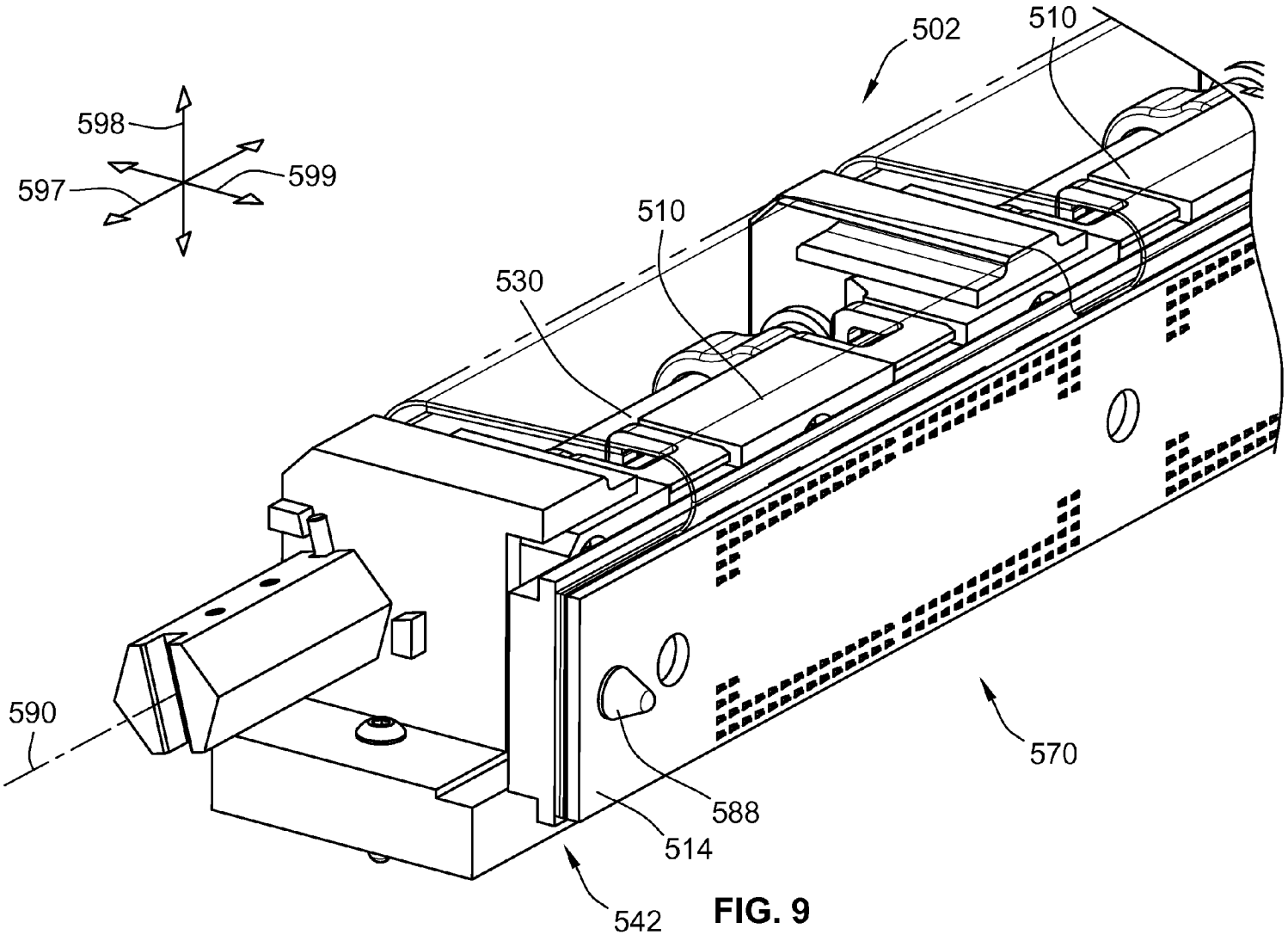
FIG. 9 is an enlarged front perspective view of the electrical connector assembly shown in FIG. 7 in an engaged position.

FIGS. 7-9 illustrate an electrical connector assembly 502 formed in accordance with another embodiment. FIG. 7 is a rear perspective view of the electrical connector assembly 502 configured to move a mating side 542 from a retracted position (shown in FIG. 7) to an engaged position (shown in FIG. 9). Although not shown, the electrical connector assembly 502 may be affixed to a motherboard proximate to a secondary circuit board having an array of board contacts for engaging the mating side 542. The electrical connector assembly 502 includes a base frame 508 that supports a coupling mechanism 504 that is configured to move the mating side 542 between the retracted and engaged positions. The coupling mechanism 504 includes an axle 530 that extends along an axis 590, a plurality of cam fingers 532 coupled to the axle 530, and a header 509 having multiple header sections 510 that are coupled to the mating side 542. The axle 530 has an end 531 that is configured to be engaged by an operator for rotating the axle 530 about an axis 590. Furthermore, the base frame 508 includes a plurality of axle supports 522. The electrical connector assembly 502 also includes a circuit assembly 511 comprising a plurality of flex circuit sections 515 (indicated by phantom lines in FIG. 7). The flex circuit sections 515 are coupled to a bottom 596 of the electrical connector assembly 502 and extend around the axis 590 to the mating side 542.

FIG. 8 is cross-sectional view of the electrical connector assembly 502 taken along the line 8-8 shown in FIG. 7. The circuit assembly 511 may include the flex circuit sections 515 and contact arrays 513 and 514. The flex circuit sections 515 extend around the coupling mechanism 504 to communicatively couple the contact array 513 on the bottom 596 to the contact array 514 of the mating side 542. More specifically, the flex circuit sections 515 extend from the contact array 513 along a non-mating side 552 and a top 554 of the electrical connector assembly 502. The circuit assembly 511 may include board stiffeners 556 for supporting and providing a shape to the flex circuit sections 515 when a flex circuit section 515 is moved between the retracted and engaged positions. As shown in the retracted position, the flex circuit sections 515 may have additional length to allow the mating side 542 to be moved between the retracted and engaged positions.

The contact arrays 513 and 514 and the flex circuit sections 515 of the circuit assembly 511 may be manufactured as one unit. The contact array 513 may be an interposer that engages the flex circuit section(s) 515 on one side of the interposer and engages a motherboard on the other side of the interposer. The mating contacts of the contact array 513 may include press-fit contacts or solder-ball contacts that are affixed to the motherboard to facilitate holding the electrical connector assembly 502 thereto. Alternatively, other mating contacts may be used.

The mating side 542 includes the contact array 514, a substrate 560, and a panel 562 that are all coupled together (e.g., with screws or adhesives) and extend substantially parallel to the axis 590 of the axle 530. The contact array 514 in FIG. 8 is an interposer, but the contact array 514 may take other forms in alternative embodiments. As shown, the substrate 560 is coupled to the flex circuit section 515 and is sandwiched between the contact array 514 and the panel 562. The substrate 560 may include contacts and conductors (not shown) that communicatively couple the contact array 514 to the flex circuit section 515. The panel 562 is floatably attached to the header section 510 (only one header section 510 is shown in FIG. 8) via a plurality of springs 564. The mating side 542 also includes an alignment projection 588 that projects away from the contact array 514.

Also shown in FIG. 8, the coupling mechanism 504 includes a roll bar 566 that is coupled to and extends through the headers 510 parallel to the axis 590. The roll bar 566 has a roll surface 567 that contacts a finger surface 533 of the cam finger 532. In FIG. 8, the coupling mechanism 504 and the mating side 542 are in the retracted position. In the retracted position, the cam finger 532 extends longitudinally toward the bottom 596 and the finger surface 533 is shaped to at least partially conform to the shape of the roll surface 567 so that the axle 530 does not inadvertently rotate.

When the axle 530 is rotated in a clockwise direction as indicated by the arrow $R_2$, the cam fingers 532 push the roll surface 567 and roll bar 566 away from the axle 530 in a mating direction M. The header 510, likewise, moves in the mating direction M thereby moving the mating side 542 outward away from the axle 530 and toward the secondary circuit board (not shown). Although not shown, the coupling mechanism 504 may be biased (e.g., by a spring force) such that a biasing force $F_B$ biases the header 510 and the roll bar 566 in a direction toward the axle 530. When the axle 530 is rotated in a counter-clockwise direction, the biasing force $F_B$ moves the header 510 and the roll bar toward the axle 530. Accordingly, the mating side 542 may be moved between the retracted and engaged positions.

FIG. 9 is an enlarged front perspective view of the electrical connector assembly 502 in the engaged position. When the mating side 542 is moved from the retracted position to the engaged position, the alignment projection 588 may engage an aperture (not shown) of the secondary circuit board (not shown). As described above with respect to FIG. 5B, the alignment projection 588 may engage the aperture and move mating contacts 570 of the contact array 514 into alignment with an array of board contacts (not shown). If the mating and board contacts are misaligned as the contact array 514 approaches the secondary circuit board, the mating side 542 may float with respect to the headers 510 and the axle 530 in order to align and engage the mating and board contacts. For example, the springs 564 (FIG. 8) allow the mating side 542 to move in different directions. The mating side 542 may move slightly along a vertical plane formed by axes 598 and 597 when the alignment projection 588 engages the aperture. The vertical plane extends parallel or in a common direction with the axis 590. The springs 564 may also allow the mating side 542 to rotate slightly about the axis 598 or slightly about an axis 599. Moreover, the springs 564 may be configured to provide an outward mating force to maintain the electrical connection between the mating and board contacts when the mating and board contacts are engaged with each other.

Figure 10:
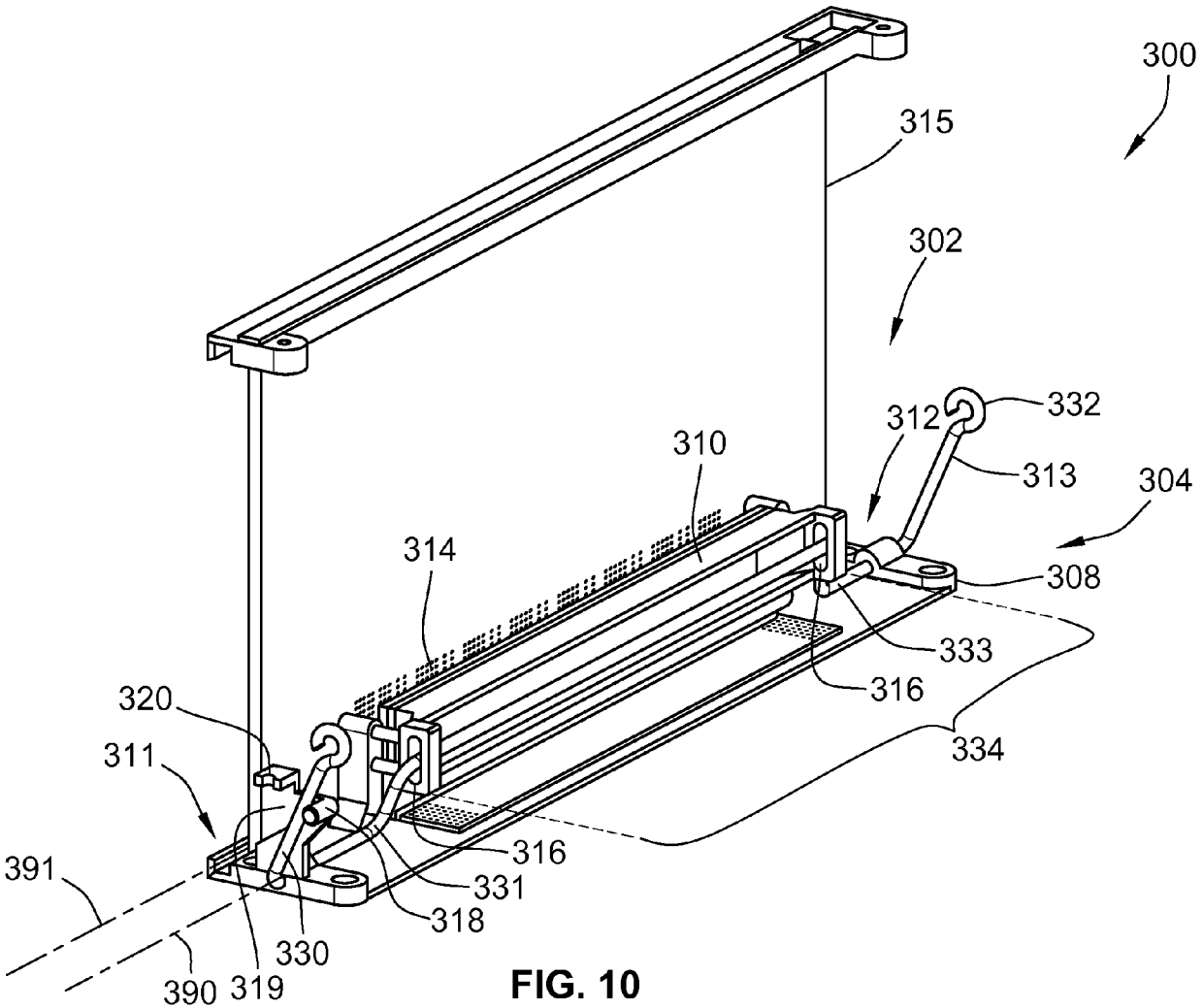
FIG. 10 is a perspective view of an electrical connector assembly formed in accordance with an alternative embodiment.
Figure 11:
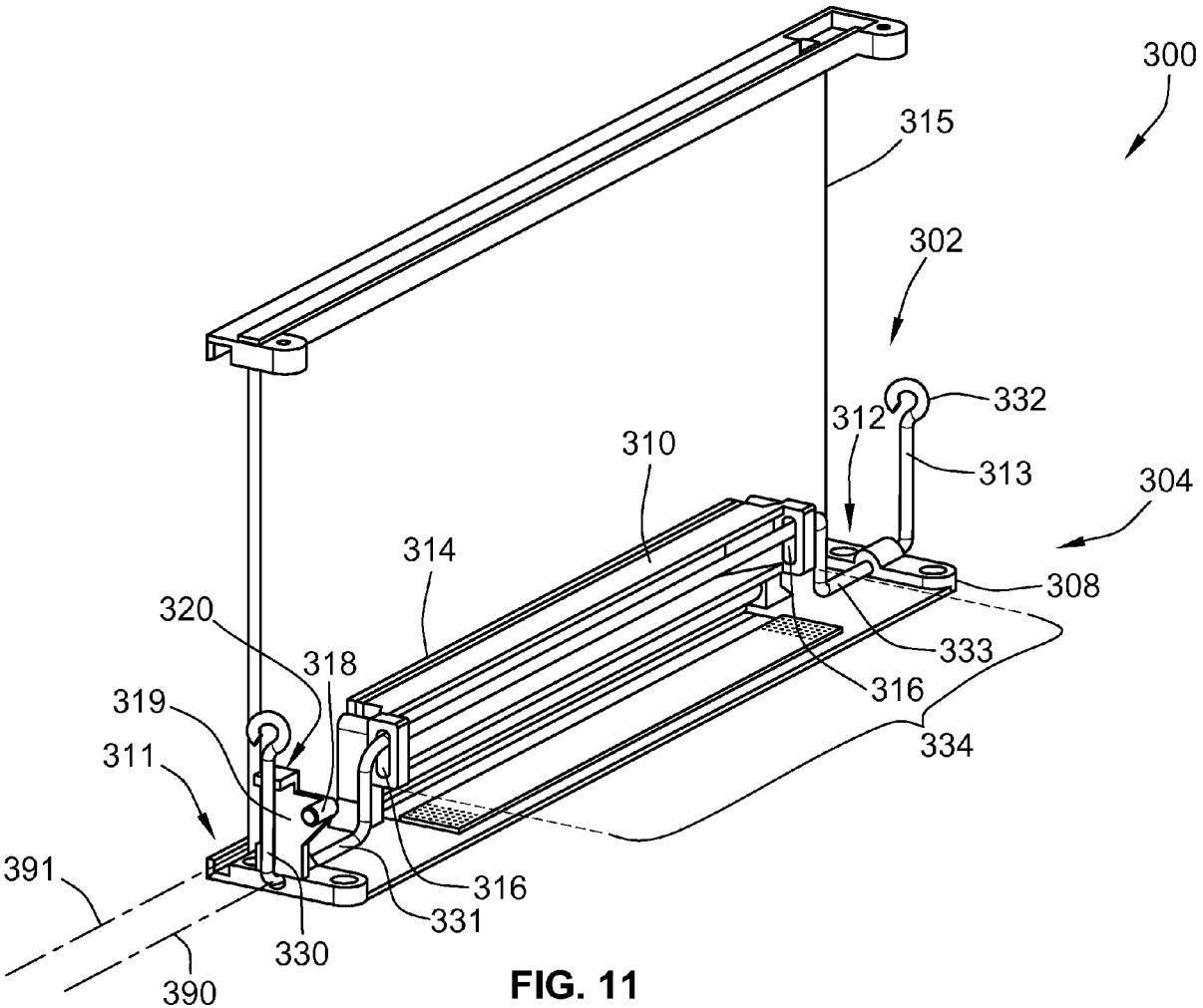
FIG. 11 is a perspective view of the electrical connector assembly shown in FIG. 10 while in an engaged position.

FIGS. 10 and 11 are perspective views of an electrical system 300 that includes an electrical connector assembly 302 formed in accordance with an alternative embodiment. FIG. 10 shows the electrical connector assembly 302 in a retracted position, and FIG. 11 shows the electrical connector assembly 302 in an engaged position. The electrical connector assembly 302 includes the coupling mechanism 304 and a circuit assembly (not shown), which may have similar components and features as the circuit assembly 106 (FIG. 1). The coupling mechanism 304 is configured to move a contact array 314 of the circuit assembly toward and away from a secondary circuit board 315 and between the engaged and retracted positions. The coupling mechanism 304 includes a base frame 308, a header 310 configured to hold the contact array 314, and an actuator assembly 312 configured to move the header 310 toward and away from the secondary circuit board 315. Also shown, the base frame 308 may include a board holder 311 for holding the secondary circuit board 315 proximate to the electrical connector assembly 302. The board holder 311 is shown as a guide channel in FIGS. 10 and 11 that receives the secondary circuit board 315 and allows the secondary circuit board 315 to slide into position proximate to the electrical connector assembly 302.

The actuator assembly 312 includes a lever structure 313 and cam slots 316 that are coupled to the header 310. The actuator assembly 312 may also include an upright 319 that projects from the base frame 308 and forms a positive stop 318 and holder notch 320. As shown in FIGS. 10 and 11, the lever structure 313 cooperates with the cam slots 316 and header 310 in order to move the contact array 314 into the engaged and retracted positions. More specifically, the lever structure 313 has a cylindrical body that includes a pair of opposing arms 330 and 332 that project in a common vertical direction and a level portion 334 that extends between the arms 330 and 332 in a longitudinal direction. The level portion 334 connects to the arm 330 through a base portion 331 and connects to the arm 332 through a base portion 333. The base portions 331 and 333 extend along a common axis 390, whereas the level portion 334 extends along a separate but parallel axis 391. The level portion 334 also extends between and through the cam slots 316. Also shown, the arms 330 and 332 and level portion 334 extend away from base frame 308 in a common direction such that the arms 330 and 332 and the level portion 334 are co-planar. However, the arms 330 and 332 and the level portion 334 may not be co-planar in alternative embodiments. Furthermore, alternative embodiments may include only one arm 330 or arm 332.

In the retracted position, the arm 330 may rest against the positive stop 318. When the lever structure 313 is moved such that the arms 330 and 332 and the level portion 334 rotate about the axis 390, the level portion 334 pushes the header 310 toward the secondary circuit board 315. As the level portion 334 pushes the header 310, the cam slots 316 allow the body of the level portion 334 to slide upward therein. As shown in FIG. 11, when the header 310 is in the engaged position, the arm 330 of the lever structure 313 may rest within the holder notch 320. The holder notch 320 may provide a locking feature or mechanism that prevents the contact array 314 from being inadvertently disengaged with the secondary circuit board 315.

In one alternative embodiment, the electrical connector assembly 302 does not include cam slots 316 that allow the lever structure 313 to move in a vertical direction therein. Rather, the header 310 may be affixed to the lever structure 313 such that the header 310 rotates about the axis 390 and moves from a retracted position, where the contact array 314 forms an obtuse angle with respect to the secondary circuit board 315, to a engaged position where the contact array 314 is parallel to and alongside the secondary circuit board 315.

Figure 12:
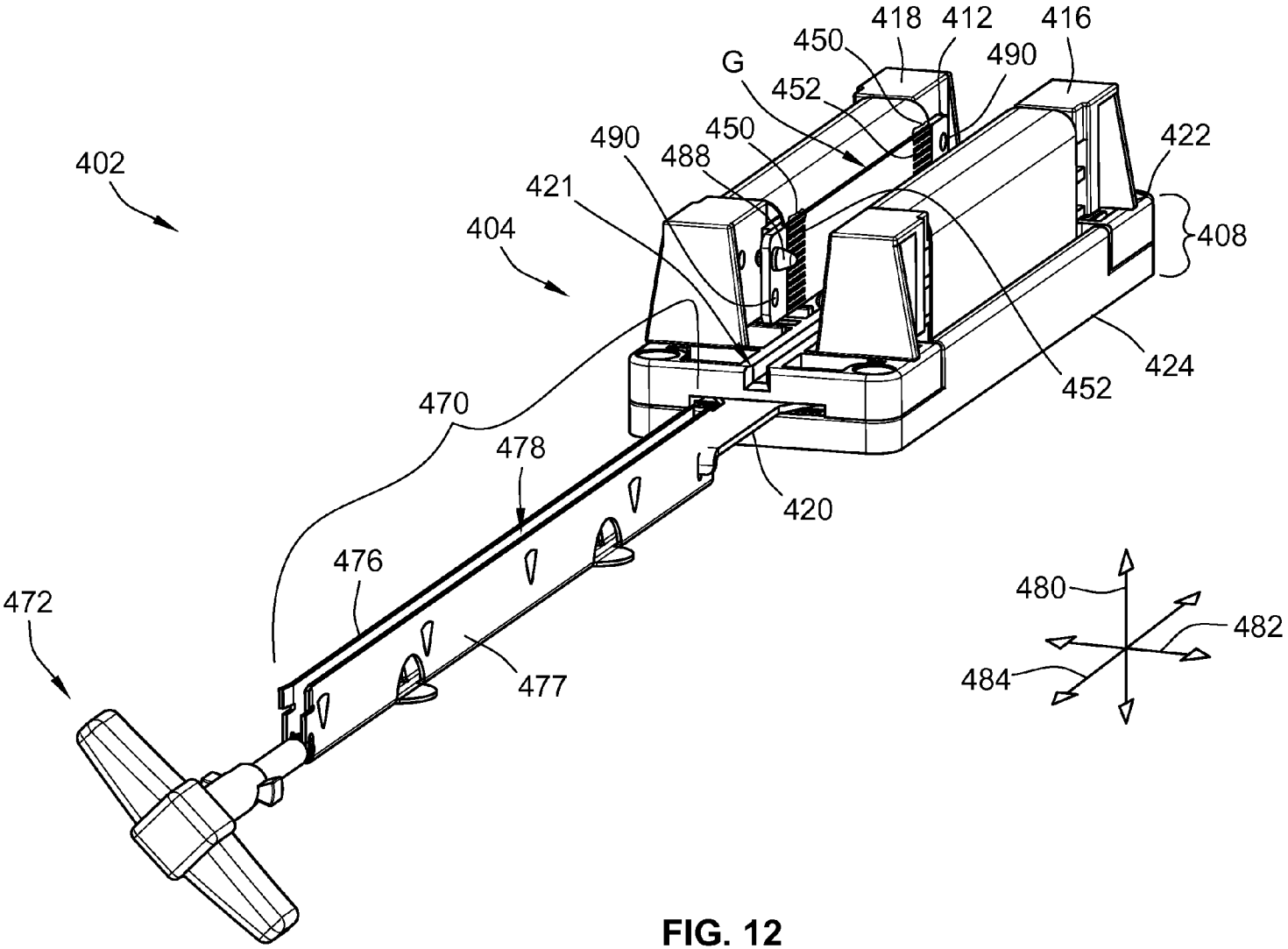
FIG. 12 is a perspective view of an electrical connector assembly formed in accordance with one embodiment.

FIGS. 12-16 illustrate an electrical connector assembly 402 that may be formed in accordance with another embodiment. FIG. 12 is a perspective view of the electrical connector assembly 402. The electrical connector assembly 402 includes a coupling mechanism 404 that is configured to move two contact arrays 410 (FIG. 13) and 412 toward a secondary circuit board 405 (shown in FIG. 16) that is positioned between the contact arrays 410 and 412. The secondary circuit board 405 has an array of mating contacts (not shown) on both sides of the secondary circuit board 405 that engage corresponding arrays 450 of mating contacts 452 on the contact arrays 410 and 412.

As shown, the coupling mechanism 404 includes a base frame 408, a pair of headers 416 and 418 that are slidably coupled to the base frame 408, and a sliding member 420 that is operatively coupled to the pair of headers 416 and 418 for moving the contact arrays 410 and 412 toward and away from the secondary circuit board 405. As will be discussed in greater detail below, the sliding member 420 is configured to move between an inserted position 492 (shown in FIG. 14) and a withdrawn position 489 (shown in FIG. 15). When the sliding member 420 is in the inserted position, the contact arrays 410 and 412 are in an engaged position (shown in FIG. 16) and electrically coupled to the secondary circuit board 405. When the sliding member 420 is in the withdrawn position, the contact arrays 410 and 412 are in a retracted position (shown in FIG. 12) and the secondary circuit board 405 may be removed from the electrical connector assembly 402.

The contact arrays 410 and 412 oppose each other across a gap G where the secondary circuit board 405 is held. Each of the contact arrays 410 and 412 or headers 416 and 418 may include an alignment projection 488 that projects from the corresponding surface and a bore 490 that is configured to receive the alignment projection 488 from the opposing contact array or header. With reference to the contact array 412 in FIG. 12, each end of the contact array 412 may include one alignment projection 488 and one bore 490. Although not shown, the opposing contact array 410 may also include an alignment projection 488 and bore 490. When in the engaged position, the alignment projection 488 of the contact array 410 extends through an aperture (not shown) of the secondary circuit board 405 and into the corresponding bore 490 of the opposing contact array 412. Likewise, the alignment projection 488 of the contact array 412 extends through an aperture of the secondary circuit board 405 and into the corresponding bore 490 of the opposing contact array 410. As such, the secondary circuit board 405 is sandwiched between the contact arrays 410 and 412. The alignment projections 488 and the bores 490 of the contact arrays 410 and 412 may cooperate with each other to facilitate aligning the mating contacts 452 with the corresponding board contacts.

Also shown in FIG. 12, the electrical connector assembly 402 includes a slot extension 470 that couples to the sliding member 420 at one end and couples to a knob 472 at an opposing end. The slot extension 470 and knob 472 may facilitate an operator or machine in removing the secondary circuit board 405. The slot extension 470 extends lengthwise along a longitudinal axis 484 and includes a pair of opposing sidewalls 476 and 477 that form a channel 478 therebetween. The channel 478 aligns with a guide channel 421 formed by the base frame 408 such that the secondary circuit board 405 may be held by both channels 478 and 421 when inserted into the electrical connector assembly 402.

In an alternative embodiment, the knob 472 may be operatively coupled to the sidewalls 476 and 477 such that when the knob 472 is in a rotated position, the sidewalls 476 and 477 are separated slightly more in order to allow the secondary circuit board 405 to slide freely along the slot extension 470. When the knob 472 is then rotated to a locked position, the sidewalls 476 and 477 may compress or grip an edge of the secondary circuit board 405 thereby locking or holding the secondary circuit board 405 in position.

Figure 13:
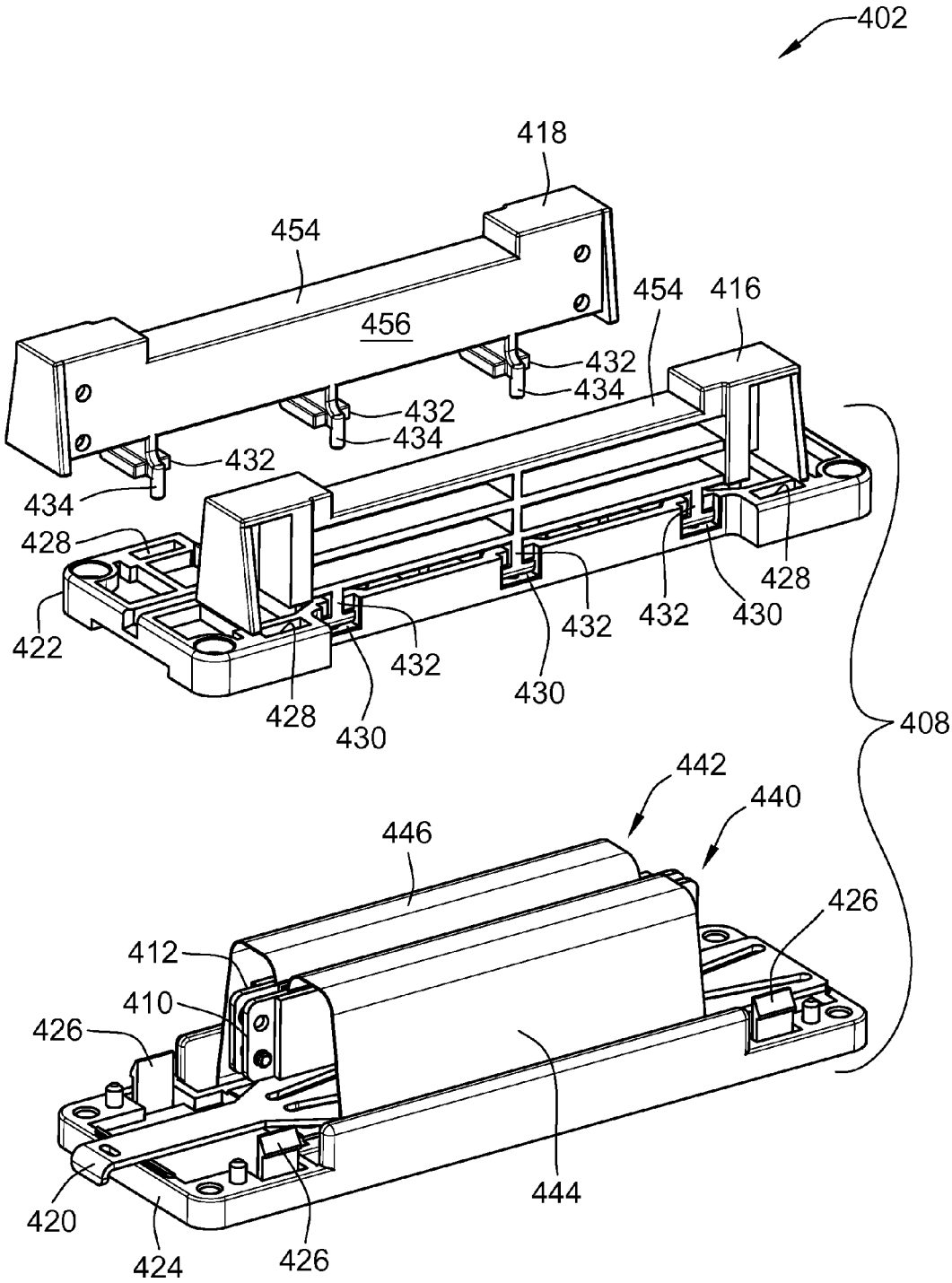
FIG. 13 is an exploded view of the electrical connector assembly shown in FIG. 12.

As shown in FIG. 13, the base frame 408 may include a top portion 422 and a bottom portion 424. When the base frame 408 is constructed, the sliding member 420 is inserted between the top and bottom portions 422 and 424, respectively, and held therebetween. The bottom portion 424 may have tabs or latches 426 that project toward the top portion 422 and are configured to engage apertures 428 within the top portion 422 when the top and bottom portions 422 and 424 are combined. Also shown, the top portion 422 may include passages 430 distributed along each side of the top portion 422. Each passage 430 is configured to receive a leg support 432 of one of the headers 416 and 418. The leg supports 432 may slide within the corresponding passage 430 in a direction that is parallel to a horizontal axis 482 (FIG. 12) (i.e., orthogonal to the longitudinal direction). Each leg support 432 includes a cam member 434 that projects downwardly in a direction parallel to a vertical axis 480 (FIG. 12).

The electrical connector assembly 402 includes circuit assemblies 440 and 442. The circuit assembly 442 includes the contact array 412 and a flexible circuit 446 that is coupled to the contact array 412. When the electrical connector assembly is fully assembled, the flexible circuit 446 may wrap around a top 454 of the header 418 and the contact array 412 may be floatably coupled to a face 456 of the header 418. The flexible circuit 446 has a length that is configured to allow the corresponding contact array 412 to be moved between the engaged and retracted positions. Similarly, the circuit assembly 440 includes the contact array 410 and a flexible circuit 444, which may be assembled as described above with respect to the circuit assembly 442.

Figure 14:
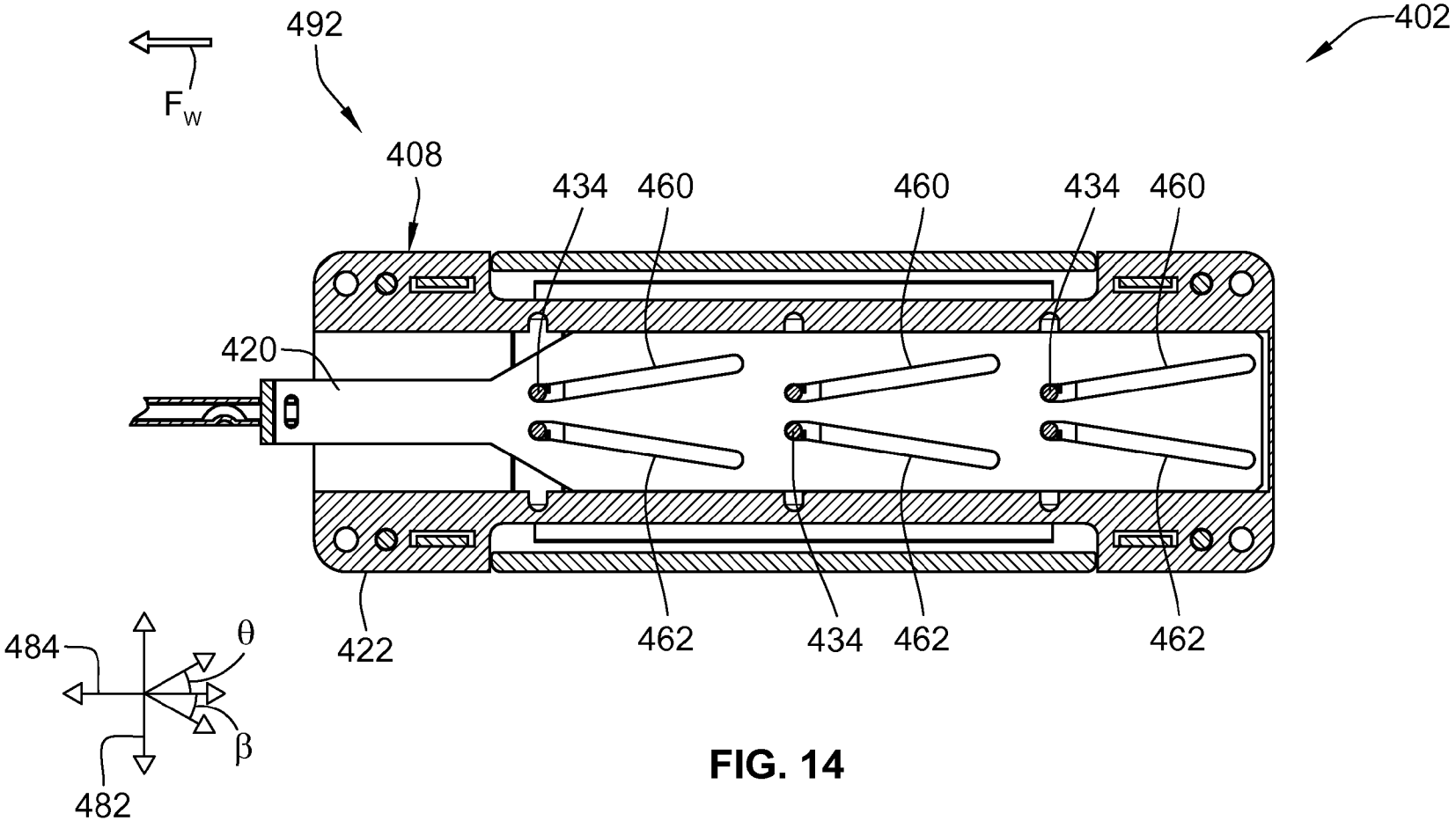
FIG. 14 is a bottom cross-sectional view of a coupling mechanism used with the electrical connector assembly shown in FIG. 12 when in an engaged position.
Figure 15:
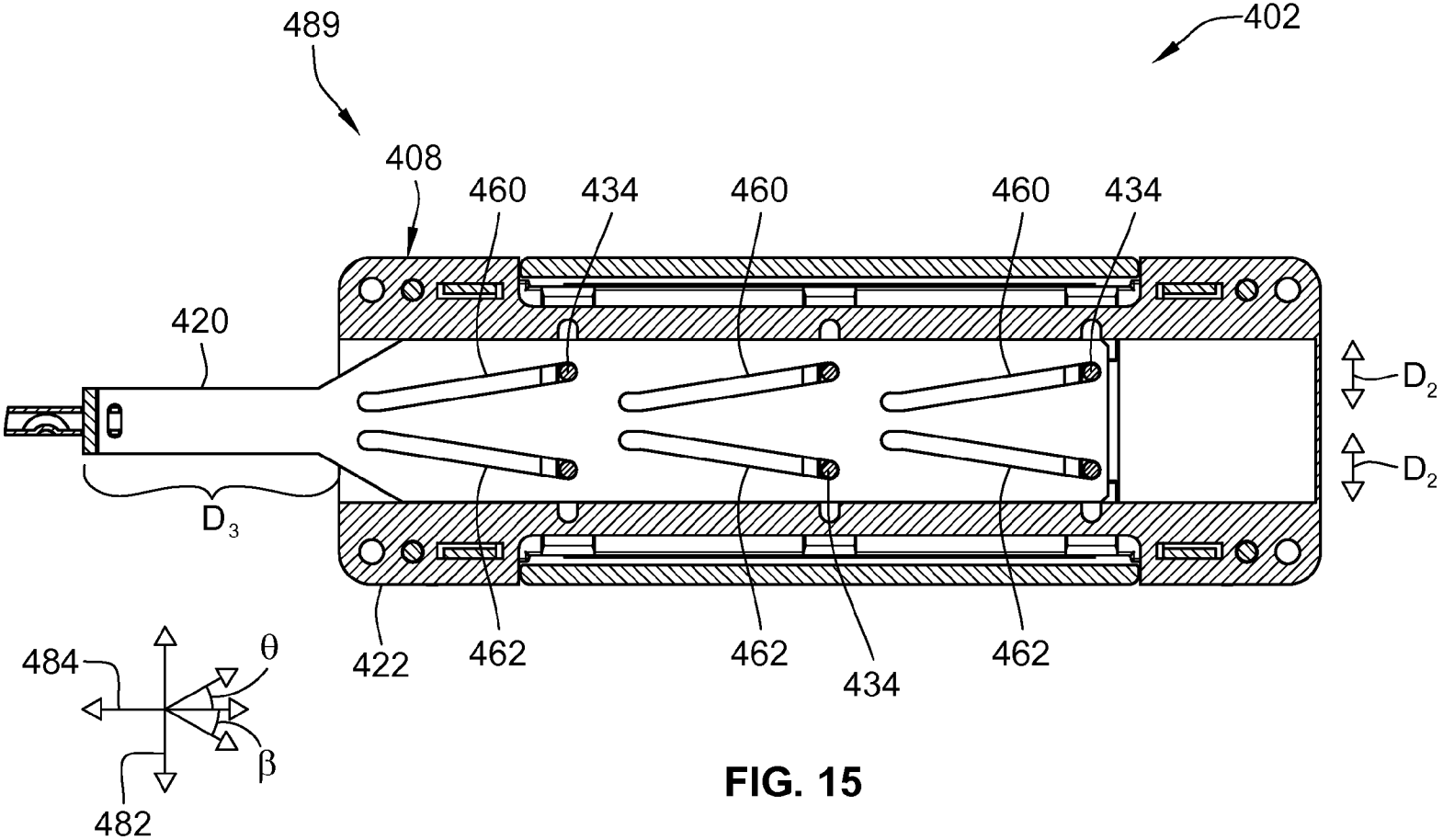
FIG. 15 is the bottom cross-sectional view of the coupling mechanism of FIG. 12 when in a retracted position.

FIGS. 14 and 15 are bottom cross-sectional views of the electrical connector assembly 402 when the sliding member 420 is in the inserted and withdrawn positions 492 and 489, respectively. The sliding member 420 has a substantially flat body configured to slide in and out of the base frame 408 a distance $D_3$ (FIG. 15). The sliding member 420 substantially extends along a length of the base frame 408 and includes two series of cam slots 460 and 462 that extend lengthwise along the body of the sliding member 420. Each cam slot 460 forms an angle with respect to the axis 484 (indicated as an angle θ) and projects in a common direction with respect to the other cam slots 460. Likewise, each cam slot 462 forms an angle (indicated as an angle β) with respect to the axis 484 and projects in a common direction with respect to the cam slots 462. As shown, the angle β has an equal value as θ, but extends away from the axis 484 in a different direction (i.e., downward instead of upward).

When a withdrawing force $F_W$ (FIG. 14) pulls the sliding member 420 along the axis 484 and away from the base frame 408, the cam slots 460 and 462 are configured to move the cam members 434 away from the secondary circuit board 405 (shown in FIG. 16) causing the corresponding headers 416 (FIG. 12) and 418 (FIG. 12) to be moved away from the secondary circuit board 405 (i.e., along the axis 482). As such, the withdrawing force $F_W$ is translated into a separating force or movement that simultaneously moves the headers and corresponding contact arrays away from the secondary circuit board 405. Furthermore, because the series of cam slots 460 and 462 are symmetrical, the corresponding headers 416 and 418 move an equal distance $D_2$ (FIG. 15) away from the circuit board 405.

However, alternative embodiments are not required to have symmetrical series of cam slots 460 and 462 and the angles θ and β are not required to be equal. Furthermore, the headers 416 and 418 are not required to move an equal distance. For example, in an alternative embodiment, the angle θ may be greater than the angle β. When the sliding member 420 is withdrawn, the header 416 moves at a greater pace and to a greater distance than the header 418.

Figure 16:
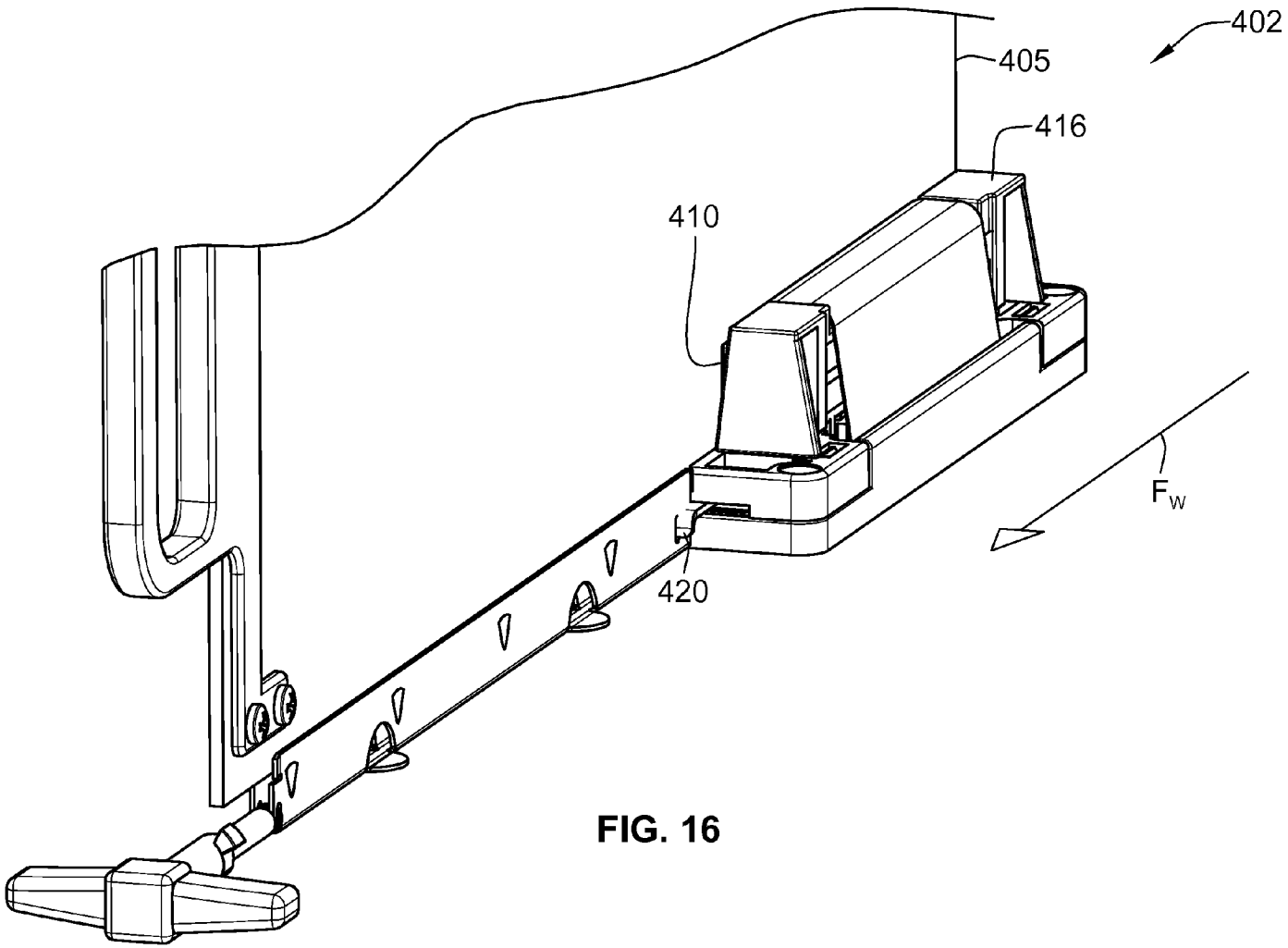
FIG. 16 is a perspective view of the electrical connector assembly shown in FIG. 12 while in the engaged position.

FIG. 16 is a rear perspective view of the electrical connector assembly 402 in the engaged position with the secondary circuit board 405. To remove the secondary circuit board 405, an operator may apply the withdrawing force $F_W$ as described above. When the sliding member 420 is moved, the cam slots 460 and 462 (FIG. 14) force the headers 416 and 418 (FIG. 12) away from each other thereby disengaging the contact arrays 410 and 412 (FIG. 13), respectively, from the secondary circuit board 405. An operator's hand or tool or an automated machine may then remove the secondary circuit board 405.

Thus, it is to be understood that the above description is intended to be illustrative, and not restrictive. As such, many other configurations and types of coupling mechanisms may be constructed other than the coupling mechanisms 204 (shown in FIG. 3), 504 (FIG. 7), 304 (FIG. 10), and 404 (FIG. 12) that electrically couples an array of mating contacts to an array of board contacts by moving the arrays toward and away from each other.

Furthermore, although the illustrated examples show primary and secondary circuit boards extending along respective planes that are perpendicular to one another, in alternative embodiments, the primary and secondary circuit boards may be oriented in other positional relationships. For example, in some alternative embodiments, the primary and secondary circuit boards may be parallel to one another. In such embodiments, an electrical connector assembly affixed to one of the primary and secondary circuit boards may be configured to move a contact array between retracted and engaged positions as described above in order to electrically engage the other circuit board.

In addition, the above-described embodiments (and/or aspects thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third." etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly for electrically coupling primary and secondary circuit boards together, the secondary circuit board having a first contact array of board contacts thereon, the electrical connector assembly comprising:

a circuit assembly including a second contact array of mating contacts configured to mate with the first contact array and a flexible circuit that electrically couples the second contact array to the primary circuit board;

an alignment feature that has a fixed position relative to the second contact array; and a coupling mechanism supporting the alignment feature and the second contact array, wherein the coupling mechanism is configured to selectively move the alignment feature and the second contact array between a retracted position, in which the second contact array is spaced apart from the first contact array, and an engaged position, in which the first and second contact arrays engage one another, the alignment feature aligning the first and second contact arrays when the coupling mechanism selectively moves the second contact array toward the engaged position in a misaligned manner relative to the first contact array.

2. The electrical connector assembly in accordance with claim 1 wherein the circuit assembly further comprises one of a printed circuit and an interposer having the second contact array of mating contacts thereon.

3. The electrical connector assembly in accordance with claim 2 wherein the circuit assembly includes the printed circuit, the printed circuit having a rigid substrate configured to support the second contact array of mating contacts along a common plane.

4. The electrical connector assembly in accordance with claim 1 further comprising a board holder configured to hold the secondary circuit board in a stationary position, the coupling mechanism configured to selectively move the second contact array of mating contacts and the alignment feature between the engaged and retracted positions when the secondary circuit board is in the stationary position.

5. The electrical connector assembly in accordance with claim 1 further comprising a board holder configured to hold the secondary circuit board orthogonal with respect to the primary circuit board.

6. The electrical connector assembly in accordance with claim 1 further comprising a board holder that includes a guide channel configured to receive the secondary circuit board, the guide channel extending along and proximate to the coupling mechanism.

7. The electrical connector assembly in accordance with claim 6 wherein the coupling mechanism further comprises a base frame that includes the board holder, the base frame configured to couple to the primary circuit board.

8. The electrical connector assembly in accordance with claim 1 wherein the coupling mechanism is configured to be locked into the engaged position such that the coupling mechanism does not inadvertently disengage the first and second contact array of mating contacts.

9. The electrical connector assembly in accordance with claim 1 wherein the circuit assembly comprises an interposer having the second contact array of mating contacts thereon.

10. The electrical connector assembly in accordance with claim 1 wherein the alignment feature is one of an alignment projection and an aperture, said alignment projection or aperture configured to directly engage another alignment feature that has a fixed relationship with respect to the first contact array.

11. An electrical connector assembly comprising:

a primary circuit board;

a board holder configured to hold a secondary circuit board proximate to the primary circuit board, the secondary circuit board having a first contact array of mating contacts thereon;

a circuit assembly including a second contact array of mating contacts configured to mate with the first contact array and a flexible circuit that electrically couples the second contact array to the primary circuit board;

an alignment feature that has a fixed position relative to the second contact array; and a coupling mechanism supporting the alignment feature and the second contact array, wherein the coupling mechanism is configured to selectively move the alignment feature and the second contact array between a retracted position, in which the second contact array is spaced apart from the first contact array, and an engaged position, in which the first and second contact arrays engage one another, the alignment feature aligning the first and second contact arrays when the coupling mechanism moves the second contact array toward the engaged position in a misaligned manner relative to the first contact array.

12. The electrical connector assembly in accordance with claim 11 wherein the circuit assembly further comprises one of a printed circuit and an interposer having the second contact array of mating contacts thereon.

13. The electrical connector assembly in accordance with claim 11 wherein the board holder is configured to hold the secondary circuit board in a stationary position prior to the coupling mechanism moving the second contact array of mating contacts and the alignment feature into the engaged position, the secondary circuit board being held substantially orthogonal with respect to the primary circuit board.

14. The electrical system in accordance with claim 11 wherein the coupling mechanism further comprises a base frame that includes the board holder, the base frame being mountable to the primary circuit board.

15. The electrical system in accordance with claim 11 wherein the alignment feature is one of an alignment projection and an aperture, said alignment projection or aperture configured to directly engage another alignment feature that has a fixed relationship with respect to the first contact array.

16. The electrical connector assembly in accordance with claim 11 wherein the second contact array includes a mating surface and the mating contacts include resilient beams projecting from the mating surface, the resilient beams being configured to flex to and from the mating surface, the mating surface moving with the resilient beams when the second contact array is moved.

17. The electrical connector assembly in accordance with claim 11 wherein the coupling mechanism is configured to selectively move the second contact array and the alignment feature in a linear manner along an axis between the engaged and retracted positions.

18. The electrical connector assembly in accordance with claim 11 wherein the coupling mechanism includes a base frame and an actuator assembly supported by the base frame, the actuator assembly configured to selectively move the second contact array between the engaged and retracted positions.

19. The electrical connector assembly in accordance with claim 18 wherein the actuator assembly includes one of a sliding member, a lever structure, and a rotatable axle movably supported by the base frame.

20. The electrical connector assembly in accordance with claim 11 wherein the second contact array is floatably coupled to the coupling mechanism, the second contact array being floatable in at least one direction along a plane that extends parallel to a surface of the secondary circuit board that has the first contact array thereon.

* * * * *